US010717302B2

(12) United States Patent
Yanagidaira

(10) Patent No.: US 10,717,302 B2
(45) Date of Patent: Jul. 21, 2020

(54) RECORDING APPARATUS

(71) Applicant: SEIKO EPSON CORPORATION, Tokyo (JP)

(72) Inventor: Naotoshi Yanagidaira, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/365,313

(22) Filed: Mar. 26, 2019

(65) Prior Publication Data

US 2019/0299661 A1 Oct. 3, 2019

(30) Foreign Application Priority Data

Mar. 27, 2018 (JP) ..... 2018-060398

(51) Int. Cl.
*B41J 11/00* (2006.01)
*B41J 25/00* (2006.01)

(52) U.S. Cl.
CPC ..... *B41J 11/002* (2013.01); *B41J 11/0015* (2013.01); *B41J 25/001* (2013.01); *B41J 2202/20* (2013.01)

(58) Field of Classification Search
CPC .... B41J 11/002; B41J 11/0015; B41J 25/001; B41J 2202/20
See application file for complete search history.

(56) References Cited

U.S. PATENT DOCUMENTS

2016/0332462 A1 11/2016 Harayama et al.

FOREIGN PATENT DOCUMENTS

JP 2013-119214 * 6/2013 ..... B41J 3/04
JP 2016-215428 12/2016

* cited by examiner

*Primary Examiner* — Geoffrey S Mruk
(74) *Attorney, Agent, or Firm* — Workman Nydegger

(57) ABSTRACT

An ink jet-type printer includes a recording mechanism performing recording on a continuous sheet transported along a transport path, a transport base and frames disposed downstream of the recording mechanism in the transport path and supporting the continuous sheet, on which the recording has been performed by the recording mechanism, and a heating unit disposed facing the transport base and the frames and heating the continuous sheet supported by the transport base and the frames. The heating unit is pivotable away from the transport base and the frames about a hinge portion serving as a pivoting center disposed at an end portion of the heating unit downstream in the transport direction of the continuous sheet.

5 Claims, 17 Drawing Sheets

RECORDING APPARATUS

BACKGROUND

1. Technical Field

The present invention relates to a recording apparatus including a heater that heats and dries a medium after recording.

2. Related Art

As such a type of recording apparatus, a printing apparatus has been known such as that described in, for example, JP2016-215428A. Such a printing apparatus includes a driving unit that transports a medium through a transport path, a placing table on which the transported medium is placed, a head that discharges ink onto the medium placed on the placing table, and a drying device disposed downstream of the head in the transport path of the medium.

The drying device is disposed facing the surface of the medium on which the ink discharged from the head is deposited and includes a first heating body and a second heating body disposed below (downstream of) the first heating body. The lower edge portion of the first heating body and the upper edge portion of the second heating body are coupled with a hinge portion such that the first heating body and the second heating body are pivotable relative to each other. The pivoting of the first heating body and the second heating body relative to each other allows the drying device to expand and contract in directions along the transport path of the medium.

Then, in the drying device of the printing apparatus described above, when the first heating body and the second heating body are caused to pivot relative to each other from an expanded state to a contracted state, the upper edge portion of the first heating body and the lower edge portion of the second heating body bend along the transport path of the medium such that the first heating body and the lower edge of the second heating body approach each other. Thus, when the medium is jammed between the drying device and the placing table, the jammed medium becomes stuck between the upper edge portion of the first heating body and the lower edge portion of the second heating body even when the first heating body and the second heating body are caused to pivot relative to each other from the expanded state to the contracted state in an attempt to remove the jammed medium. As a result, there is problem in that removal of the medium jammed between the drying device and the placing table is difficult.

SUMMARY

The present invention has been conceived in light of the above-described problems in the related art. An advantage of some aspects of the present invention is to provide a recording apparatus that allows easy removal of a jammed medium when the medium is jammed between a heater and a medium support unit.

Hereinafter, means for eliminating the above-described problems and advantages of the means will be described.

A recording apparatus solving the above-described issues includes a recording unit configured to perform recording on a medium transported along a transport path, a medium support unit disposed in the transport path downstream of the recording unit and configured to support the medium, on which the recording has been performed by the recording unit, and a heater disposed to face the medium support unit and configured to heat the medium supported by the medium support unit, wherein the heater is pivotable away from the medium support unit about a hinge portion serving as a pivoting center disposed on the heater at an end portion downstream of the transport direction of the medium.

According to this configuration, when the heater is caused to pivot, an end of the heater upstream in the transport direction of the medium is positioned farthest away from the medium support unit. Thus, when the medium is jammed between the heater and the medium support unit, the jammed medium can be readily removed.

The recording apparatus preferably includes a braking mechanism configured to reduce a pivoting speed of the heater.

According to this configuration, even when the heater is forcibly caused to pivot, the pivoting speed of the heater is reduced by the braking mechanism. Thus, the impact on the heater and the components around the heater caused by pivoting of the heater can be reduced.

In the recording apparatus, the braking mechanism preferably includes an engaging portion disposed on one of the medium support unit and the heater, and a guiding part disposed on the other of the medium support unit and the heater and configured to slidably guide the engaging portion, and when the heater is caused to pivot, the pivoting speed of the heater is reduced by a sliding resistance between the engaging portion and the guiding part.

According to this configuration, even when the heater is forcibly caused to pivot, the pivoting speed of the heater can be reduced by the sliding resistance between the engaging portion and the guiding part.

In the recording apparatus, the engaging portion preferably is a rod member, and the guiding part preferably has an elongated hole through which the rod member is slidably inserted.

According to this configuration, the configuration of the braking mechanism can be simplified.

In the recording apparatus, preferably the elongated hole is partially provided a sliding-resistance increasing portion where sliding resistance between the rod member and the sliding-resistance increasing portion increases.

According to this configuration, even when the heater is forcibly caused to pivot, the sliding resistance between the rod member and the elongated hole increases at the sliding-resistance increasing portion. Thus, the pivoting speed of the heater can be effectively reduced.

In the recording apparatus, the rod member is preferably formed of a material harder than a material of the guiding part.

In general, when rod members and guiding parts are formed of the same material, sliding the rod member relative to the elongated holes in the guiding parts often causes local wear in a part of the rod member that is in constant contact with the elongated holes due to friction with the elongated holes. As a result, the service life of the rod members tends to be short. In this regard, since the rod member is formed of a material harder than that of the guiding parts in this configuration, the wear of the rod member due to friction with the elongated hole is suppressed. Thus, the service life of the rod member can be extended.

In the recording apparatus, a width in a short direction of a first area of the elongated hole where the rod member is preferably positioned when the heater is caused to pivot to a first position farthest from the medium support unit and a width in a short direction of a second area of the elongated hole where the rod member is preferably positioned when the heater is caused to pivot to a second position closest to the medium support unit are larger than a width in a short direction of a third area of the elongated hole where the rod member is positioned when the heater is caused to pivot between the first position and the short direction.

According to this configuration, the movable distance of the first area and the second area of the elongated hole in the short direction relative to the rod member can be made larger than the shiftable distance of the third area of the elongated hole in the short direction relative to the rod member.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Exemplary Embodiment

With reference to the drawings, description is given below of a recording apparatus of a first exemplary embodiment of the invention implemented as an ink jet-type printer.

Figure 1:
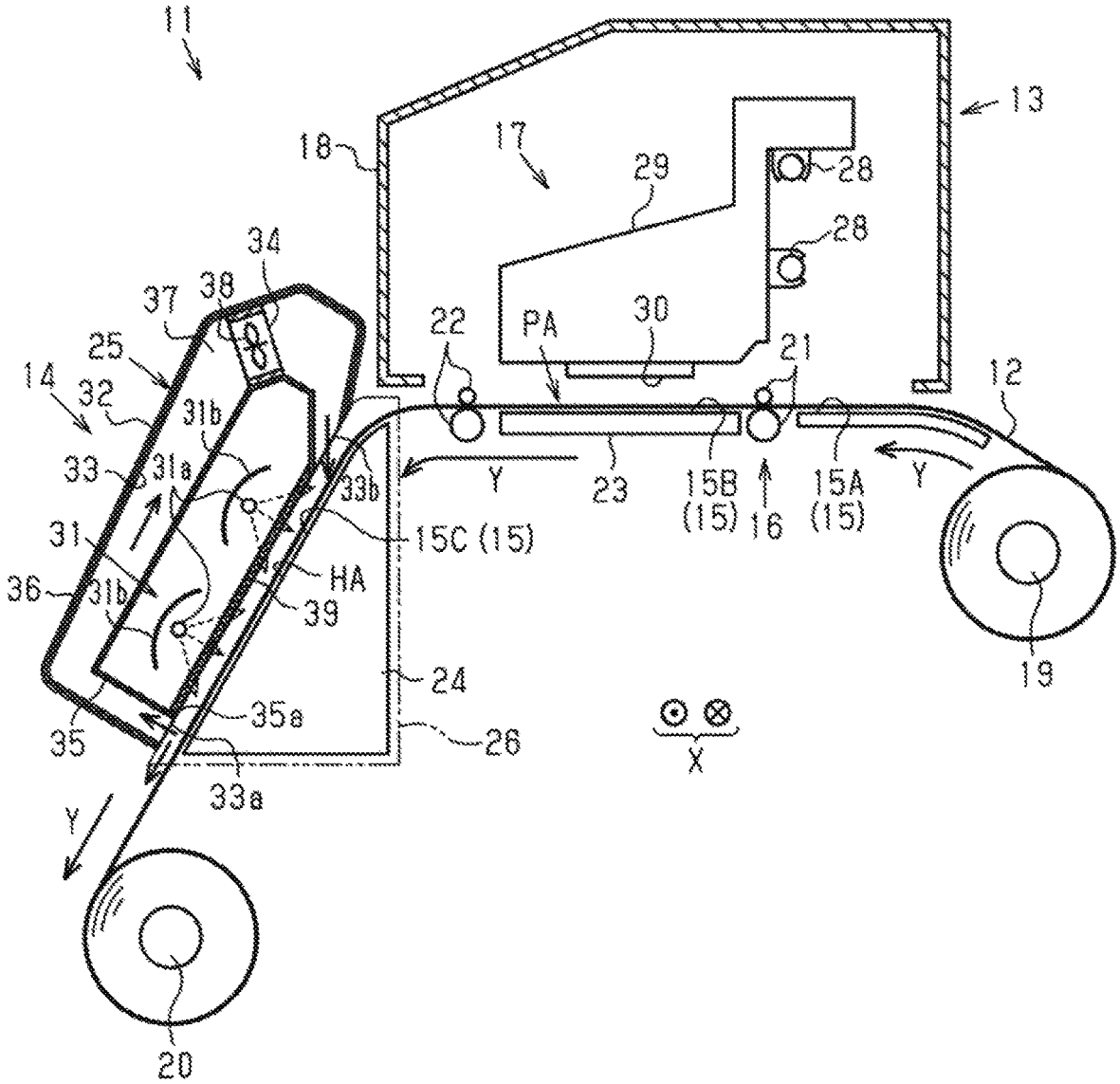
FIG. 1 is a schematic side view of an ink jet-type printer according to a first exemplary embodiment.

As illustrated in FIG. 1, an ink jet-type printer 11 as an example of the recording apparatus includes a recording unit 13 that discharges ink as an example of liquid on a continuous sheet 12 as an example of a medium for recording (printing) on the continuous sheet 12, and a drying unit 14 that heats and dries the continuous sheet 12 after recording by the recording unit 13. The ink used by the ink jet-type printer 11 of this exemplary embodiment is made of, for example, a dye ink or a pigment ink and contains an evaporable liquid component, such as water, as a solvent or dispersion medium.

The recording unit 13 includes support surfaces 15 that support the continuous sheet 12 such that the continuous sheet 12 can be guided along a transport path, a transport mechanism 16 that transports the continuous sheet 12 along the support surfaces 15, and a recording mechanism 17 as an example of a recording unit that discharges ink toward the continuous sheet 12 transported along the transport path for recording (printing). The recording mechanism 17 is housed in a container body 18 arranged at a position facing a horizontal portion of the support surfaces 15.

The transport mechanism 16 includes a first rotary shaft 19 for pivotably supporting the continuous sheet 12 wound into a roll before recording and a second rotary shaft 20 for winding the continuous sheet 12 into a roll after recording. The first rotary shaft 19 is disposed at a position upstream of the transport path of the continuous sheet 12. The second rotary shaft 20 is disposed at a position downstream of the transport path of the continuous sheet 12.

The transport mechanism 16 rotationally drives the first rotary shaft 19 with a feeding motor (not shown) serving as a power source to unwind the roll of the continuous sheet 12 and feed the continuous sheet 12. The transport mechanism 16 rotationally drives the second rotary shaft 20 with a winding motor (not shown) serving as a power source to wind the continuous sheet 12 after recording.

The transport mechanism 16 includes a plurality of transport rollers 21 and 22 that rotate while in contact with the continuous sheet 12 at positions midway along the transport path of the continuous sheet 12. The area in the transport path of the continuous sheet 12 facing the recording mechanism 17 is defined as a recording area PA. The transport rollers 21 and 22 are disposed at positions upstream and downstream, respectively, of the recording area PA in the transport path of the continuous sheet 12. The plurality of transport rollers 21 and 22 are rotationally driven by a transport motor (not shown) serving as a power source in synchronization with the recording operation of the recording mechanism 17 to transport the continuous sheet 12 in the transport direction Y.

Note that, in the exemplary embodiment, the direction of the transport path of the continuous sheet 12 along the support surfaces 15 is referred to as "transport direction Y". Accordingly, the transport direction Y varies depending on the positions of the transport path, as indicated by the solid arrow in FIG. 1. For example, the transport direction Y in the recording area PA is the horizontal direction, whereas the transport direction Y in a transport area extending between the downstream transport rollers 22 sending out the recorded continuous sheet 12 and the second rotary shaft 20 winding the continuous sheet 12 is obliquely downward.

The support surfaces 15 include a first support surface 15A that supports the continuous sheet 12 fed from the first rotary shaft 19, a second support surface 15B that supports a section of the continuous sheet 12 between the transport rollers 21 and 22 in the transport direction Y, and a third support surface 15C that supports the continuous sheet 12 downstream of the transport roller 22 after recording. The second support surface 15B constitutes the upper face of a support base 23 supporting a section of the continuous sheet 12 between the transport rollers 21 and 22.

The drying unit 14 includes a transport base 24 constituting a medium support unit that is disposed downstream of the recording mechanism 17 in the transport path of the continuous sheet 12 and supports the continuous sheet 12 after recording by the recording mechanism 17 and a heating unit 25 as an example of a heater that is disposed facing the transport base 24 and heats the continuous sheet 12 supported by the transport base 24 after recording. The transport base 24 is disposed over a section of the transport path between the downstream transport rollers 22 and the second rotary shaft 20.

Arranged on each side of the transport base 24 in the width direction X orthogonal to the transport direction Y are a pair of plate-like frames 26 that form the medium support unit and that are arranged opposite to each other across the transport base 24 in the width direction X. The transport base 24 and the frames 26 each has a substantially right triangle-shape when viewed from the width direction X. The third support surface 15C consists of the upper face of the transport base 24 that supports the continuous sheet 12 after recording and inclines downward toward downstream. In this exemplary embodiment, the inclination angle of the third support surface 15C is set to approximately 60 degrees.

Figure 2:
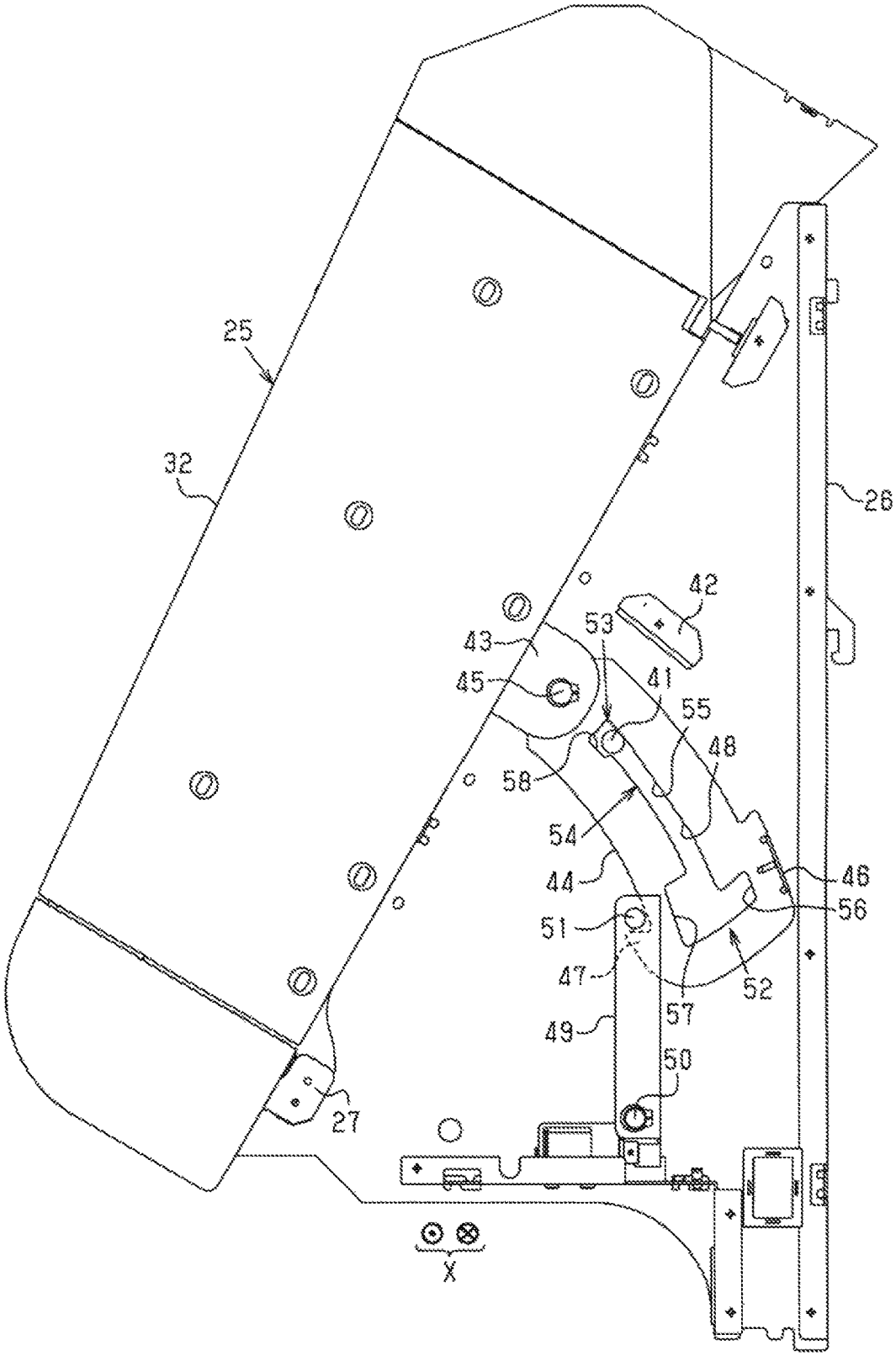
FIG. 2 is an enlarged view of the main part of FIG. 1.

With reference to FIGS. 1 and 2, the heating unit 25 is pivotably supported on the pair of frames 26 by hinge portions 27 disposed at the downstream edge portions (lower edge portions) of the heating unit 25 in the transport direction Y of the continuous sheet 12. Thus, the heating unit 25 is pivotable around the hinge portions 27 serving as pivot centers. That is, the heating unit 25 is pivotable around the pivot center or the axial line extending in the width direction X as it moves away from the transport base 24 while facing the upper surface (third support surface 15C) of the transport base 24.

In other words, the heating unit 25 is pivotable between a first position (the position illustrated in FIG. 6) in which the heating unit 25 is farthest from the third support surface 15C of the transport base 24 and a second position (the position illustrated in FIG. 2) in which the heating unit 25 is closest to the third support surface 15C of the transport base 24. In the second position, the heating unit 25 is tilted by approximately 60 degrees relative to the horizontal plane, as is the third support surface 15C, while in the first position, the heating unit 25 is tilted by approximately 85 degrees relative to the horizontal plane. Thus, the pivoting range of the heating unit 25 according to this exemplary embodiment is set to approximately 25 degrees.

Note that, while the heating unit 25 according to this exemplary embodiment is tilted by an angle less than 90 degrees (approximately 85 degrees) relative to the horizontal plane in the first position as described above, the center of gravity of the entire heating unit 25 in this state is located at an angle greater than 90 degrees relative to the horizontal plane. As a result, even when the heating unit 25 is released in the first position, the heating unit 25 spontaneously comes to a stop in a stable manner by the action of gravity without toppling toward the second position.

As illustrated in FIG. 1, the recording mechanism 17 includes guiding shafts 28 extending in the width direction X, a carriage 29 movably supported by the guiding shafts 28, and a recording head 30 supported on the bottom portion of the carriage 29. While the carriage 29 reciprocates together with the recording head 30 along the guiding shafts 28, the recording head 30 discharges and deposits ink onto the continuous sheet 12 transported through the recording area PA to record (print) on the continuous sheet 12.

The heating unit 25 includes a heating mechanism 31, a housing 32 accommodating the heating mechanism 31, an air supply passage 33 that serves as the path of an airflow circulating inside the housing 32, and an air blower 34 that generates the airflow. The heating mechanism 31 is disposed at a position facing the third support surface 15C so that it can heat the continuous sheet 12 supported on the third support surface 15C. The heating mechanism 31 includes heat-generating elements 31*a* including, for example, heater pipes.

A plurality of the heat-generating elements 31*a* (two in this example) are arranged to oppose the third support surface 15C and are spaced apart in the transport direction Y. Reflection plates 31*b* having concave reflecting surfaces are arranged on a side of the heat-generating elements 31*a* opposite to the third support surface 15C. In this manner, the heat of the heat-generating elements 31*a* is radiated toward the third support surface 15C.

The housing 32 includes an inner wall 35 surrounding the heating mechanism 31, an outer wall 36 arranged on the outside of the inner wall 35, and a pair of sidewalls 37 intersecting the outer wall 36 and the inner wall 35. The pair of sidewalls 37 cover the two edges of the outer wall 36 and the two edges of the inner wall 35 in the width direction X, which is the direction in which the pair of sidewalls 37 face each other. The air supply passage 33 is defined by a channel formed by the outer wall 36, the inner wall 35, and the sidewalls 37 surrounding the heating mechanism 31. The air supply passage 33 includes an air inlet 33*a* for intaking outside air and an air outlet 33*b* that opens toward the third support surface 13C.

The air blower 34 includes a fan 38 and is disposed in the air supply passage 33 at the upper portion of the housing 32. The air blower 34, which is disposed in a position for generating an airflow in the direction indicated by solid line arrows in FIG. 1, forces the air taken into the air supply passage 33 through the air inlet 33*a* to flow to the air outlet 33*b*. The downstream portion of the air supply passage 33 connected to the air outlet 33*b* forms a channel tapering toward the air outlet 33*b* and extending at an angle so that the air is blown diagonally down onto the third support surface 15C.

As a result, the airflow blown out from the air outlet 33*b* flows in the transport direction Y along the surface (recording surface) of the continuous sheet 12 on the third support surface 15C. Note that, since the heating unit 25 has a shape that is longer in the width direction X than in the transport direction Y, it is preferred that multiple fans 38 be arranged in the width direction X.

Furthermore, the heating mechanism 31 is arranged along the transport direction Y at a position corresponding to an area between the air outlet 33*b* and the air inlet 33*a*. Thus, the airflow blown out of the air outlet 33*b* passes through a heating area HA heated by the heating mechanism 31 to facilitate evaporation of the evaporable liquid component, such as water, in the ink deposited on the surface of the continuous sheet 12.

A metal mesh 39 is disposed over a heating port 35*a* in the housing 32 facing the third support surface 15C. Thus, the heat from the heat generating elements 31*a* propagates to the continuous sheet 12 on the third support surface 15C through the metal mesh 39, and the airflow from the air inlet 33*a* to the air outlet 33*b* is guided by the metal mesh 39 to flow along the third support surface 15C.

As illustrated in FIG. 2, a cylindrical rod member 41 extending along the width direction X is disposed substantially at the center of the inner surfaces of the pair of frames 26. The rod member 41 is an example of an engagement feature that forms a braking mechanism for reducing the speed at which the heating unit 25 pivots. The rod member 41 is formed of a metal. Magnets 42 are disposed above the rod member 41 on the inner surfaces of the pair of frames 26. Plate-shaped tongues 43 are disposed on each side of the housing 32 of the heating unit 25 in the width direction X at positions corresponding to the rod member 41.

Each of the tongues 43 pivotably supports the proximal end of a substantially rectangular plate-shaped guiding part 44 via a shaft 45 extending in the width direction X, the guiding part 44 forming the braking mechanism for reducing the speed of at which the heating unit 25 pivots. The guiding part 44 is formed of a synthetic resin. Thus, the rod member 41 is formed of a material harder than the guiding part 44. The guiding part 44 is supported by the tongue 43 via the shaft 45 such that the guiding part 44 is suspended diagonally downward by its own weight. A plate 46 formed of a magnetic material, such as metal, is secured to the upper face of the distal end of the guiding part 44. A hook portion 47 is disposed on the lower face of the distal end of the guiding part 44.

An elongated hole 48 extending in the longitudinal direction is formed in the central portion of the guiding part 44. The rod member 41 is slidably disposed in the elongated hole 48. The elongated hole 48 in the guiding part 44 slidably guides the rod member 41. Vertically extending, rectangular plate-shaped stoppers 49 are disposed on the the inner faces of the pair of frames 26 at the lower end thereof. The proximal ends of the stoppers 49 are supported such that the stoppers 49 are pivotable about a shaft 50 disposed on the frames 26 and extending in the width direction X. Pins 51 extending in the width direction X are disposed at the distal ends of the stoppers 49.

Each stopper 49 is caused to pivot around the corresponding shaft 50 or the pivoting center by, for example, an actuator (not shown), such as a solenoid. That is, when the heating unit 25 is in the second position (the position illustrated in FIG. 2), the stopper 49 pivots between an engaged position (the position illustrated in FIG. 2) where the pin 51 engages the hook portion 47 of the guiding part 44 and a disengaged position (the position illustrated in FIG. 3) where the pin 51 is disengaged from the hook portion 47 of the guiding part 44. In this manner, when the stopper 49 is in the engaged position, the heating unit 25 is restricted from pivoting, and when the stopper 49 is in the disengaged position, the heating unit 25 is allowed to pivot.

The guiding part 44 moves together with the heating unit 25 pivoting between the first position (the position illustrated in FIG. 6) and the second position (the position illustrated in FIG. 2), thereby causing changes in the position of the rod member 41 within the elongated hole 48. When the heating unit 25 pivots, the speed at which the heating unit 25 pivots is reduced by the sliding resistance between the elongated hole 48 in the guiding part 44 and the rod member 41.

The area in which the rod member 41 is positioned in the elongated hole 48 when the heating unit 25 pivots to the first position is referred to as a first area 52. The first area 52 is positioned at the distal end of the guiding part 44. The area in which the rod member 41 is positioned in the elongated hole 48 when the heating unit 25 pivots to the second position is referred to as a second area 53. The second area 53 is positioned at the proximal end of the guiding part 44.

The area in which the rod member 41 is positioned in the elongated hole 48 when the heating unit 25 pivots between the first position and the second position is referred to as a third area 54. The widths of the first area 52 and the second area 53 in the short direction of the elongated hole 48 are greater than the width of the third area 54 in the short direction of the elongated hole 48. Here, the short direction of the elongated hole is a direction orthogonal to a moving direction of the guiding part 44 when the heating unit 25 pivots between the first position (the position illustrated in FIG. 6) and the second position (the position illustrated in FIG. 2). The first area 52, the second area 53 and the third area 54 are a part of the elongated hole 48.

The central portion of the elongated hole 48, which is a portion of the third area 54, has a sliding-resistance increasing portion 55 in which the width in the short direction is smaller than the width in portions other than the central portion of the third area 54 such that the sliding resistance between the elongated hole 48 and the rod member 41 is increased. In the sliding-resistance increasing portion 55, the interference between the sliding-resistance increasing portion 55 and the rod member 41 is greater than the interference between the other portions of the third area 54 other than the sliding-resistance increasing portion 55 and the rod member 41. Both of the walls of the elongated hole 48 in the short direction are curved to protrude inward in the sliding-resistance increasing portion 55 of the elongated hole 48. The width in the short direction of the other portions of the third area 54 of the elongated hole 48 other than the sliding-resistance increasing portion 55 is set slightly larger than the outer diameter of the rod member 41.

The first area 52 of the elongated hole 48 has a substantially rectangular first recess 56 that extends the elongated hole 48 toward the plate 46 and a substantially rectangular second recess 57 that extends the elongated hole 48 toward the hook portion 47. The width of the first recess 56 in the longitudinal direction of the guiding part 44 is slightly larger than the outer diameter of the rod member 41. The width of the second recess 57 in the longitudinal direction of the guiding part 44 is approximately twice the width of the first recess 56 in the longitudinal direction of the guiding part 44. The depths of the first recess 56 and the second recess 57 are each greater than the outer diameter of the rod member 41.

The second area 53 of the elongated hole 48 has a substantially rectangular third recess 58 that extends the elongated hole 48 in the short direction toward the hook portion 47. The width of the third recess 58 in the longitudinal direction of the guiding part 44 is slightly larger than the outer diameter of the rod member 41. The depth of the third recess 58 is one-half or less than the outer diameter of the rod member 41.

The operation of the ink jet-type printer 11 will now be described below.

As illustrated in FIGS. 1 and 2, when activated, the ink jet-type printer 11 performs recording (printing) on the continuous sheet 12 fed from the first rotary shaft 19 by the transport mechanism 16 as the ink discharged from the recording head 30 is deposited onto the continuous sheet 12 during transportation through the recording area PA. The continuous sheet 12 after recording is then heated and dried by the heating unit 25 during transportation over the third support surface 15C of the transport base 24 and wound by the second rotary shaft 20. Upon this, the heating unit 25 is positioned in the second position.

When the continuous sheet 12 is jammed between the heating unit 25 and the third support surface 15C during operation of the ink jet-type printer 11, the jammed continuous sheet 12 needs to be removed. To remove the continuous sheet 12 jammed between the heating unit 25 and the third support surface 15C, the heating unit 25 should be caused to pivot from the second position to the first position while the operation of the ink jet-type printer 11 is stopped.

Figure 3:
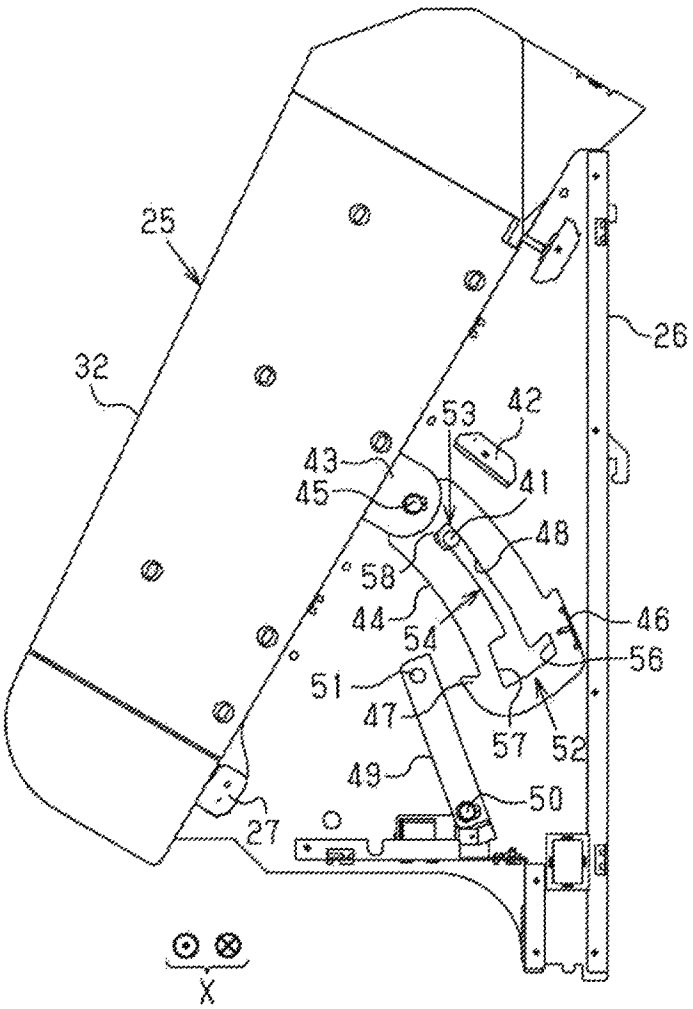
FIG. 3 is a side view illustrating an operation during pivoting of a heating unit according to the first exemplary embodiment.
Figure 4:
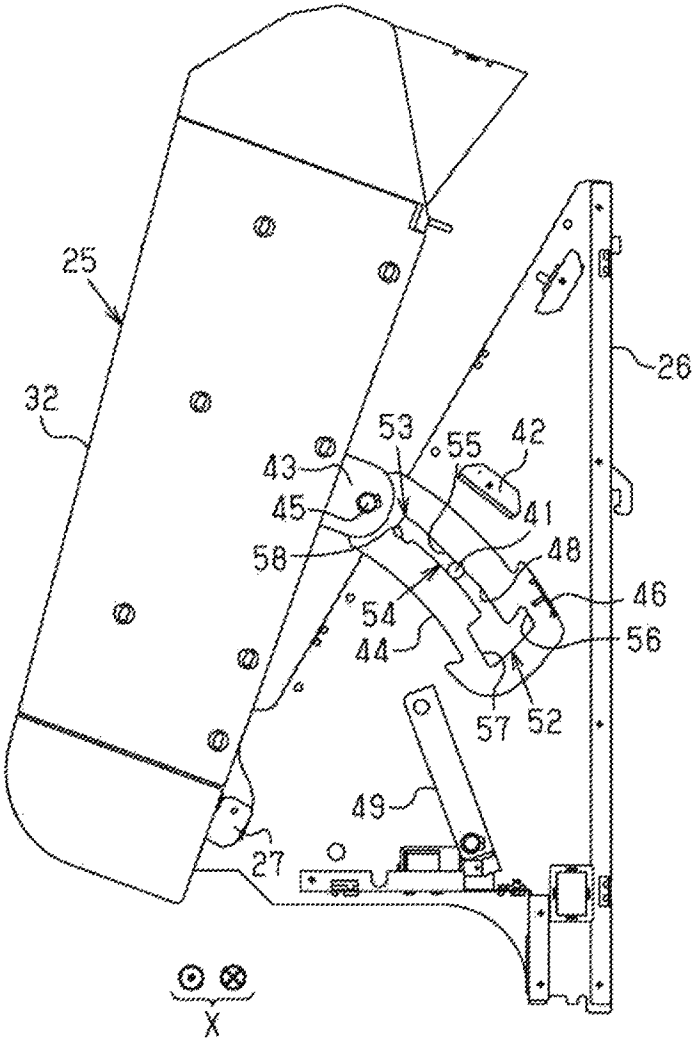
FIG. 4 is a side view illustrating an operation during pivoting of the heating unit according to the first exemplary embodiment.

Then, to pivot the heating unit 25 from the second position to the first position, first the stoppers 49 are caused to pivot from the engaged position to the disengaged position, as illustrated in FIG. 3. This disengages the pins 51 of the stoppers 49 from the hook portions 47 of the guiding parts 44, allowing the heating unit 25 to pivot from the second position to the first position. Subsequently, as the heating unit 25 is caused to pivot toward the first position, guiding parts 44 also move with the pivoting. As a result, the rod member 41 secured to the frame 26 slides from the second area 53 to the third area 54 relative to the elongated hole 48, as illustrated in FIG. 4.

Figure 5:
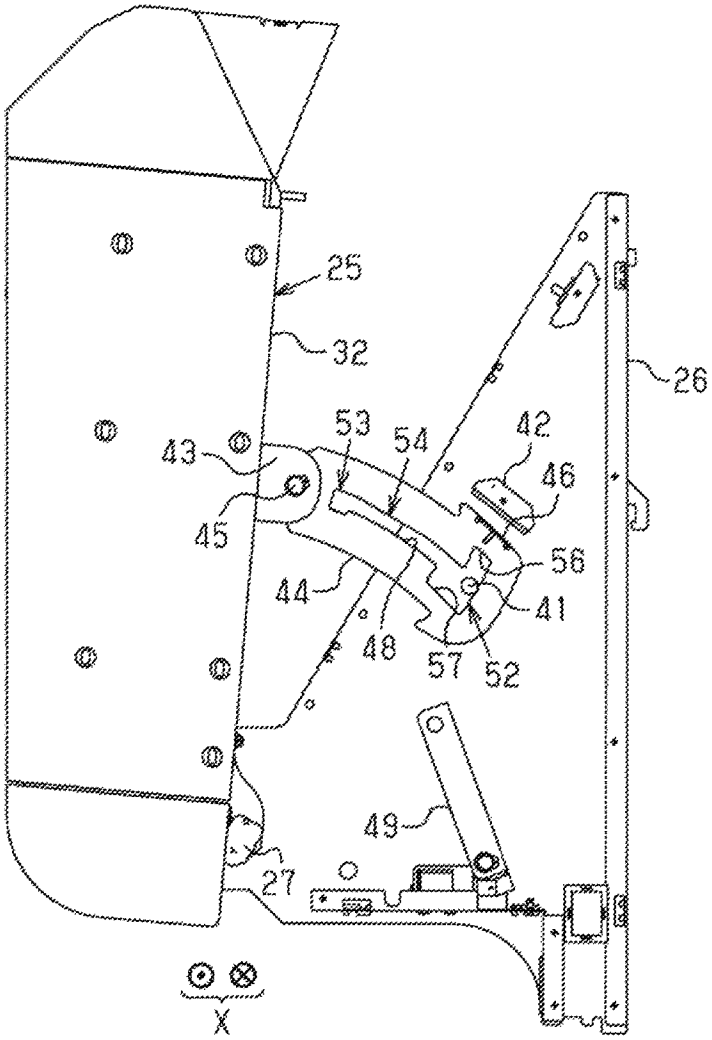
FIG. 5 is a side view illustrating an operation during pivoting of the heating unit according to the first exemplary embodiment.

Upon this, the sliding resistance between the elongated hole 48 and the rod member 41 increases at the sliding-resistance increasing portion 55 in the third area 54 to reduce the speed at which the heating unit 25 pivots particularly when the heating unit 25 is forcibly caused to pivot. Subsequently, when the heating unit 25 is caused to pivot to the first position, the rod member 41 secured to the frame 26 slides from the third area 54 to the first area 52 relative to the elongated hole 48, as illustrated FIG. 5.

Figure 6:
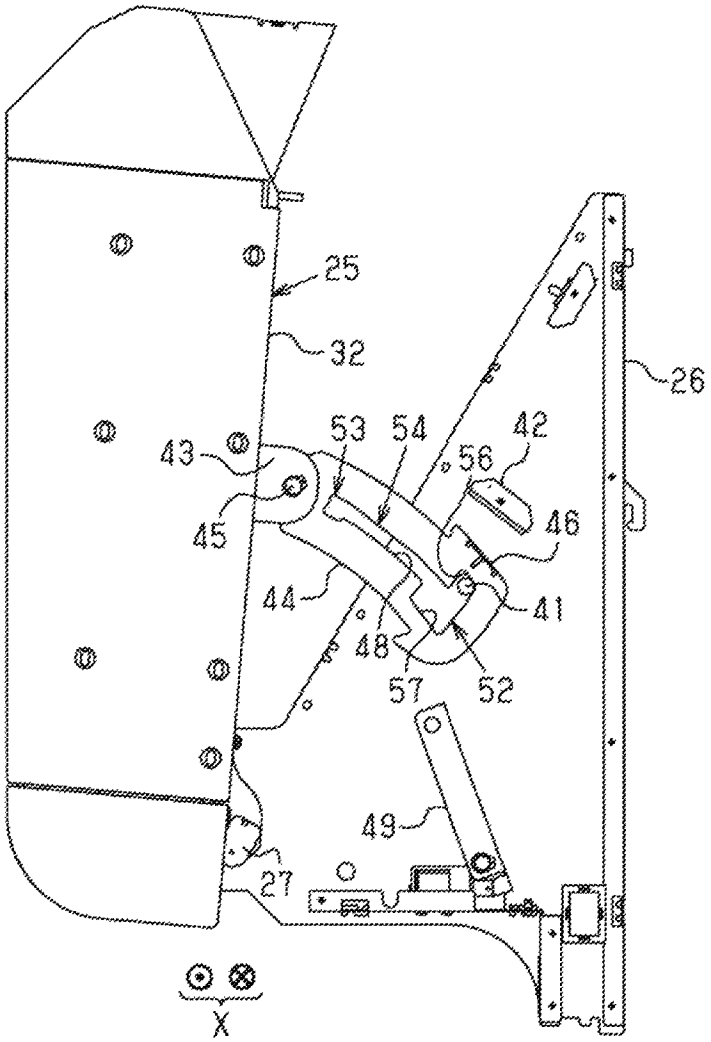
FIG. 6 is a side view illustrating an operation during pivoting of the heating unit according to the first exemplary embodiment.

Consequently, the guiding part 44 pivots about the shaft 45 or the pivoting center as the distal end of the guiding part 44 descends by the action of gravity, thereby causing the rod member 41 to move into the first recess 56, as illustrated in FIG. 6. In this way, the rod member 41 and the first recess 56 engage with each other in the pivoting direction of the heating unit 25, restricting the pivoting of the heating unit 25. Thus, the heating unit 25 stably remains still in the first position.

Subsequently, the continuous sheet 12 (see FIG. 1) jammed between the heating unit 25 and the third support surface 15C (see FIG. 1) is removed. Upon this, the distance between the heating unit 25 and the third support surface 15C (see FIG. 1) is largest at the upper edge. Thus, the jammed continuous sheet 12 (see FIG. 1) can be readily accessed from the top and readily removed.

Figure 7:
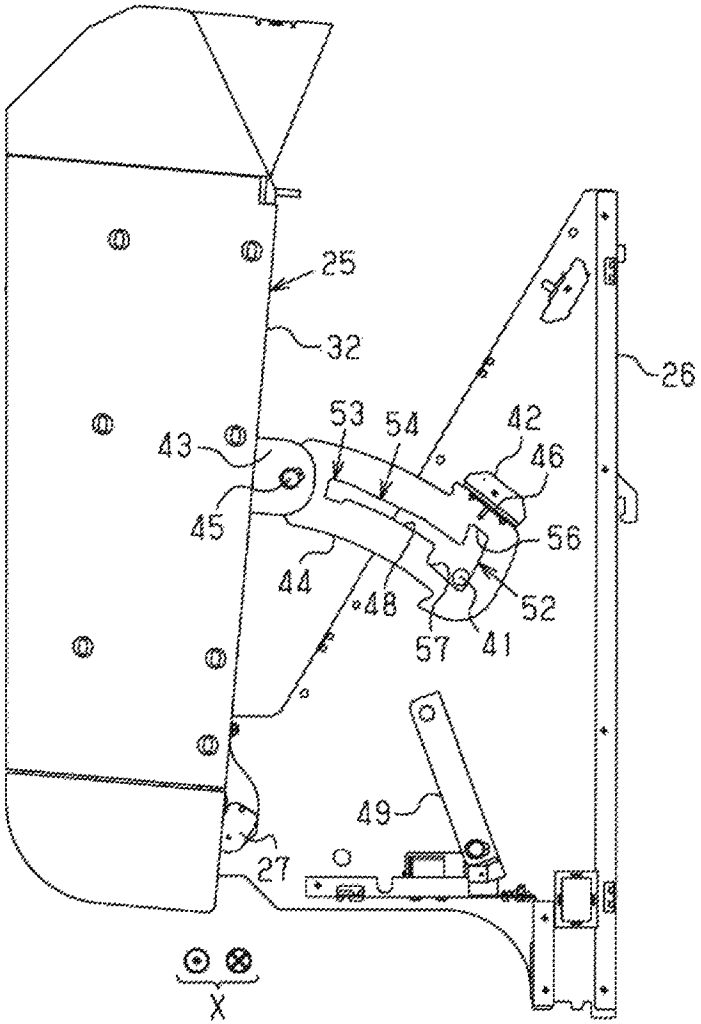
FIG. 7 is a side view illustrating an operation during pivoting of the heating unit according to the first exemplary embodiment.

Once the jammed continuous sheet 12 (see FIG. 1) has been removed, the ink jet-type printer 11 needs to be reactivated, which requires pivoting of the heating unit 25 from the first position to the second position. To pivot the heating unit 25 from the first position to the second position, the guiding part 44 is first caused to pivot about the shaft 45 or the pivoting center to move the distal end of the guiding part 44 upward. This causes the plate 46 to stick to the magnet 42, as illustrated in FIG. 7.

Figure 8:
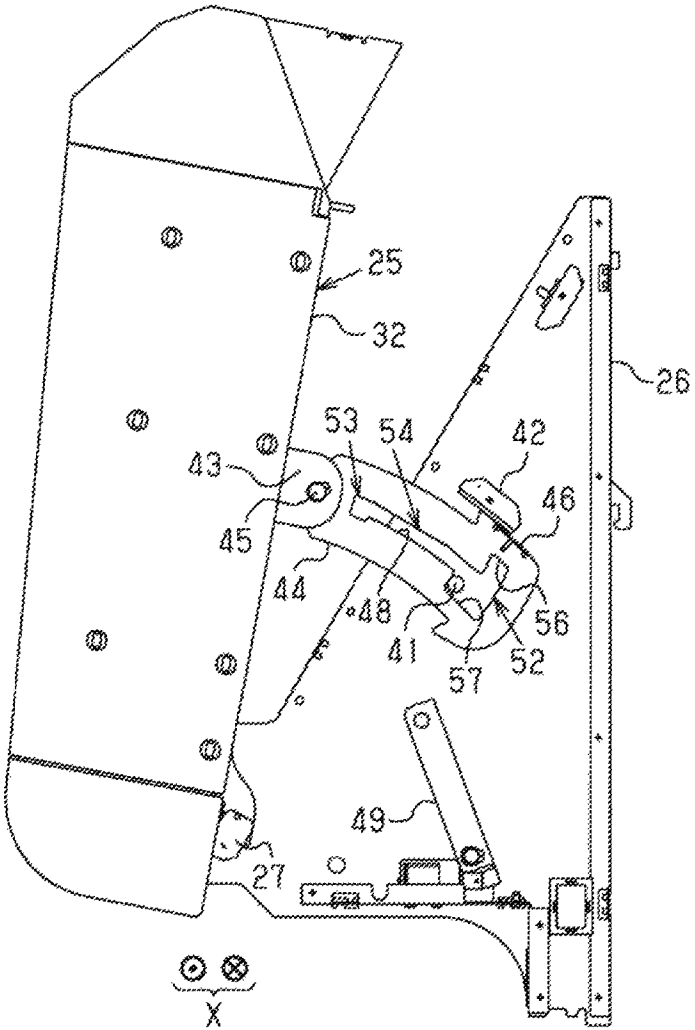
FIG. 8 is a side view illustrating an operation during pivoting of the heating unit according to the first exemplary embodiment.

Consequently, the rod member 41 exits the first recess 56 and enters the second recess 57, thus releasing engagement of the rod member 41 and the first recess 56 in the pivoting direction of the heating unit 25. This allows pivoting of the heating unit 25. Subsequently, as the heating unit 25 is caused to pivot toward the second position, the guiding part 44 also moves with the pivoting. As a result, the rod member 41 secured to the frame 26 moves relative to the second recess 57 to a position at which the rod member 41 does not face the first recess 56 in the short direction of the elongated hole 48, as illustrated in FIG. 8.

Figure 9:
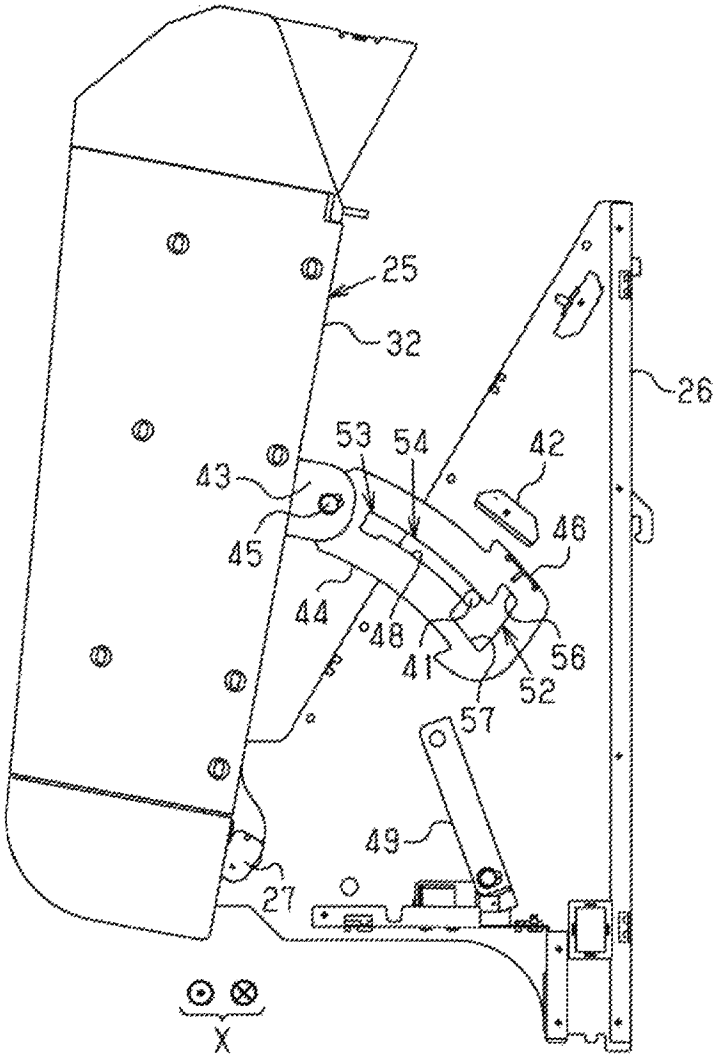
FIG. 9 is a side view illustrating an operation during pivoting of the heating unit according to the first exemplary embodiment.

Upon this, the plate 46 slides over the magnet 42 to a position shifted from where it can stick to the magnet 42. As a result, the plate 46 detaches from the magnet 42, which allows the guiding part 44 to pivot about shaft 45 or the pivoting center as the distal end of the guiding part 44 descends by the action of gravity, as illustrated in FIG. 9. This causes the rod member 41 to exit the second recess 57 and align with the third area 54 in the longitudinal direction of the elongated hole 48.

Subsequently, as the heating unit 25 is caused to pivot toward the second position, the guiding part 44 also moves with the pivoting. As a result, the rod member 41 secured to the frame 26 slides from the first area 52 into the third area 54 relative to the elongated hole 48, as illustrated in FIG. 4. Upon this, the sliding resistance between the elongated hole 48 and the rod member 41 increases at the sliding-resistance increasing portion 55 in the third area 54 to effectively reduce the speed at which the heating unit 25 pivots particularly when the heating unit 25 is heavy and is forcibly caused to pivot by the action of gravity.

Subsequently, as the heating unit 25 is caused to pivot to the second position, the guiding part 44 also moves with the pivoting. As a result, the rod member 41 secured to the frame 26 slides from the third area 54 into the second area 53 relative to the elongated hole 48, as illustrated in FIG. 3. Subsequently, the stoppers 49 are caused to pivot from the disengaged position to the engaged position. As a result, the pins 51 of the stoppers 49 engage the hook portions 47 of the guiding parts 44 as shown in FIG. 2, thus restricting the heating unit 25 from pivoting from the second position to the first position. Then, the ink jet-type printer 11 is activated.

According to the first exemplary embodiment described above, the following advantages are achieved.

(1-1) In the ink jet-type printer 11, the heating unit 25 is pivotable away from the transport base 24 about the hinge portion 27 or the pivoting center provided at an end of the heating unit 25 downstream in the transport direction Y of the continuous sheet 12. According to this configuration, when the heating unit 25 is caused to pivot to the first position, the end (upper end) of the heating unit 25 upstream in transport direction Y of the continuous sheet 12 is spaced apart by the greatest distance from the transport base 24. Thus, when the continuous sheet 12 is jammed between the heating unit 25 and the transport base 24, the jammed continuous sheet 12 can be readily removed.

1-2) The ink jet-type printer 11 includes a braking mechanism that reduces the speed at which the heating unit 25 pivots. According to this configuration, even when the heating unit 25 is forcibly caused to pivot, the braking mechanism can reduce the speed at which the heating unit 25 pivots, so that the impact applied to the heating unit 25 and the components around the heating unit 25 as a result of the pivoting of the heating unit 25 can be reduced.

(1-3) In the ink jet-type printer 11, the braking mechanism includes a rod member 41 provided on the frames 26 and guiding parts 44 provided on the heating unit 25 and having elongated holes 48 for slidably guiding the rod member 41, so that the sliding resistance between the rod member 41 and the elongated holes 48 helps reduce the speed at which the heating unit 25 pivots when the heating unit 25 is caused to pivot. According to this configuration, the configuration of the braking mechanism can be simplified, and the speed at which the heating unit 25 pivots can be reduced by the sliding resistance between the rod members 41 and the elongated holes 48 even when the heating unit 25 is forcibly caused to pivot.

(1-4) In the ink jet-type printer 11, each elongated hole 48 includes a sliding-resistance increasing portion 55 on a portion thereof that has increased sliding resistance against the rod member 41. According to this configuration, the sliding resistance between the rod member 41 and the elongated hole 48 can be increased at the sliding-resistance increasing portion 55 and thus, the speed at which the heating unit 25 pivots can be effectively reduced even when the heating unit 25 is forcibly caused to pivot.

(1-5) In the ink jet-type printer 11, the rod member 41 is formed of a material harder than that of the guiding parts 44. In general, when the rod members 41 and the guiding parts 44 are formed of the same material, sliding the rod member 41 relative to the elongated holes 48 in the guiding parts 44 often causes local wear in a part of the rod member 41 that is in constant contact with the elongated holes 48 due to friction with the elongated holes 48. As a result, the service life of the rod members 41 tends to be shorter than the service life of the guiding parts 44. In this regard, since the rod member 41 is formed of a material harder than that of the guiding parts 44 in this configuration, the wear of the rod member 41 due to friction with the elongated hole 48 can be suppressed. Thus, the service life of the rod members 41 can be extended.

(1-6) In the ink jet-type printer 11, the widths in the short direction of the first area 52 of each elongated hole 48 and the second area 53 of each elongated hole 48 are larger than the width of the third area 54 in each elongated hole 48 in the short direction. According to this configuration, the movable distance of the rod member 41 relative to the elongated hole 48 in the short direction in the first area 52 and the second area 53 can be made larger than the movable distance of the rod member 41 relative to the elongated hole 48 in the short direction in the third area 54.

Second Exemplary Embodiment

A recording apparatus according to a second exemplary embodiment will now be described below with reference to the drawings.

Figure 10:
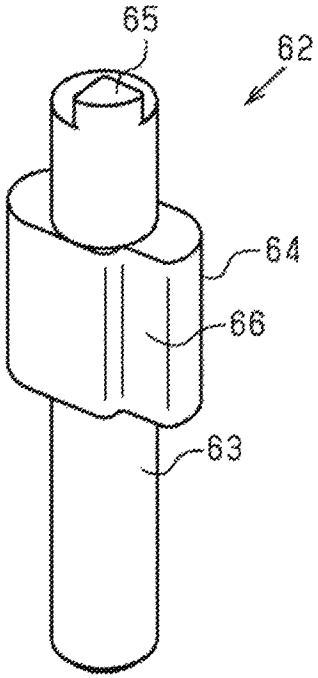
FIG. 10 is a perspective view of a rod member according to a second exemplary embodiment.
Figure 13:
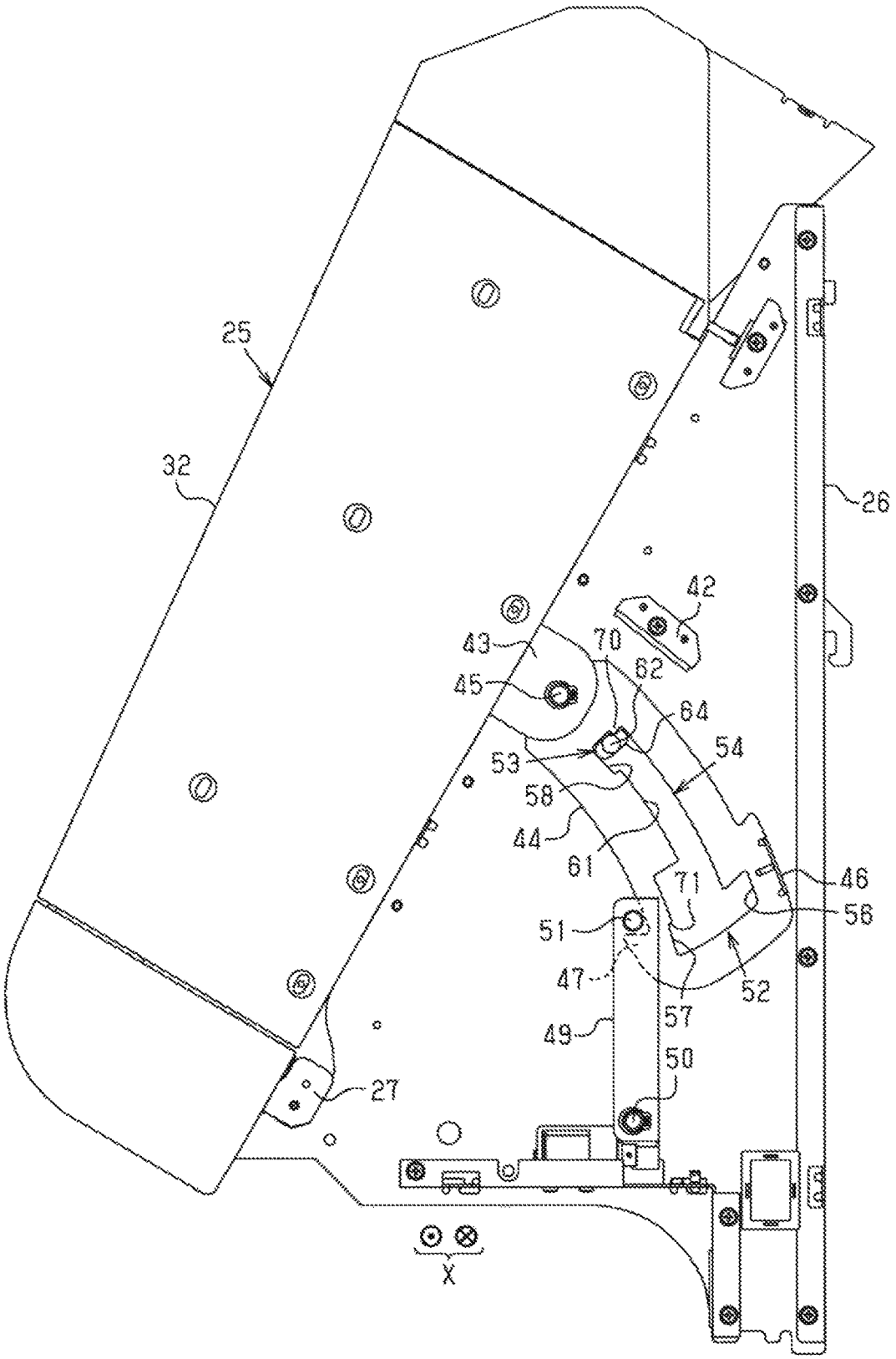
FIG. 13 is a side view of a heating unit according to the second exemplary embodiment.

In the second exemplary embodiment, the elongated holes 48 in the guiding parts 44 are replaced with modified elongated holes 61 illustrated in FIG. 13 having a size slightly larger than that of the elongated holes 48, the sliding-resistance increasing portions 55 are omitted, and the rod member 41 is replaced with a rod member 62 illustrated in FIG. 10. Other features of the second exemplary embodiment are the same as those of the first exemplary embodiment. Thus, in the second exemplary embodiment, the same components as those in the first exemplary embodiment are denoted by the same reference numerals, and redundant descriptions thereof are omitted.

As illustrated in FIG. 10, the rod member 62 includes a cylindrical body 63, a substantially elliptical cylindrical sliding portion 64 disposed on a portion of the body 63, and a sectoral protrusion 65 formed on one end face of the body 63 and having a central angle of 90 degrees. The center of the arc of the protrusion 65 is located on the central axis of the body 63. A portion of the sliding portion 64 has a cutout 66.

Figure 11:
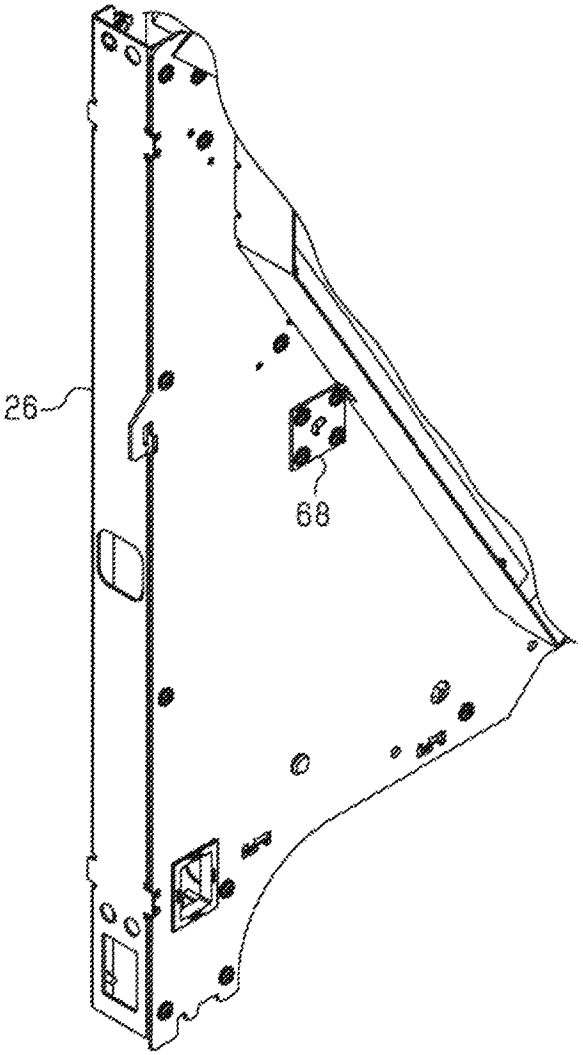
FIG. 11 is a perspective view of a frame according to the second exemplary embodiment from an external face.
Figure 12:
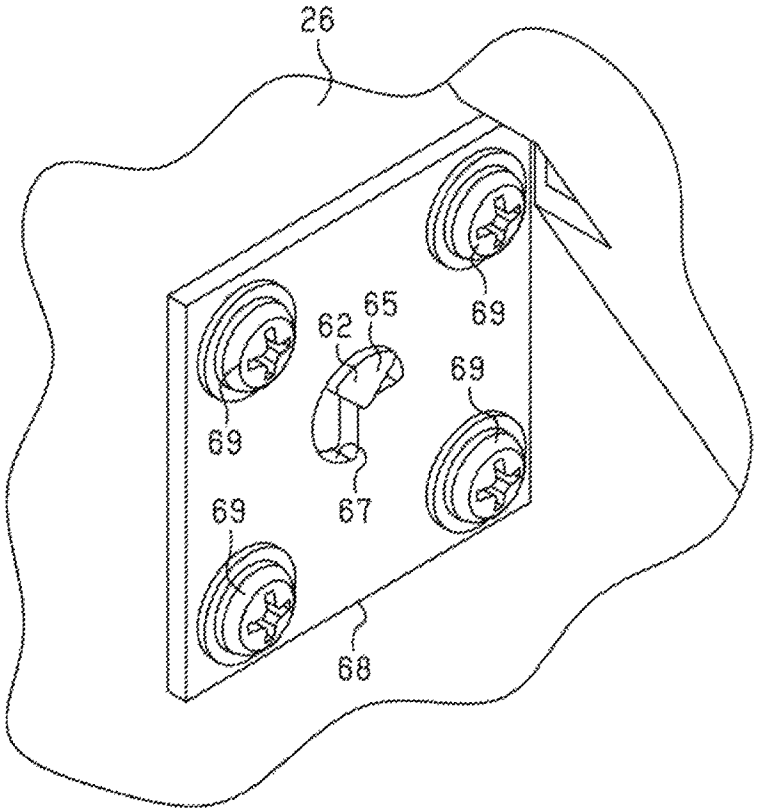
FIG. 12 is an enlarged view of the main part of FIG. 11.

As illustrated in FIGS. 11 and 12, each frame 26 has a true circular through-hole (not shown) through which the body 63 of the rod member 62 is rotatably passed. A square-shaped restricting plate 68 having a sectoral insertion hole 67 having a 270-degree central angle corresponding to the through hole is attached to the external face of the frame 26 with four screws 69. The center of the arc of the protrusion 65 is located on the central axis of the body 63 of the rod member 62 (see FIG. 10). The protrusion 65 of the rod member 62 is inserted into the insertion hole 67 when the body 63 of the rod member 62 (see FIG. 10) is inserted through a through-hole (not shown) from the inner surface of the frame 26. Thus, the pivoting range of the rod member 62 is limited to 180 degrees by the protrusion 65 inserted through the insertion hole 67.

As illustrated in FIG. 13, the sliding portion 64 of the rod member 62 is inserted through the elongated hole 61 in the guiding part 44 so as to be slidable relative to the elongated hole 61. The width of the third area 54 of the elongated hole 61 in the short direction is larger than the small diameter of the sliding portion 64 and smaller than the large diameter of the sliding portion 64. The widths of the first area 52 and the second area 53 of the elongated hole 61 in the short direction are each larger than the large diameter of the sliding portion 64. The second area 53 of the elongated hole 61 has a protruding portion 70 that can engage with the cutout 66 in the sliding portion 64 of the rod member 62. A step 71 is formed at the center of the bottom of the second recess 57 of the elongated hole 61.

The operation of the ink jet-type printer 11 will now be described below.

As illustrated in FIGS. 1 and 13, when activated, the ink jet-type printer 11 performs recording (printing) on the continuous sheet 12 fed from the first rotary shaft 19 by the transport mechanism 16 as the ink discharged from the recording head 30 is deposited onto the continuous sheet 12 during transportation through the recording area PA. The continuous sheet 12 after recording is then heated and dried by the heating unit 25 during transportation over the third support surface 15C of the transport base 24 and wound by the second rotary shaft 20.

Figure 14:
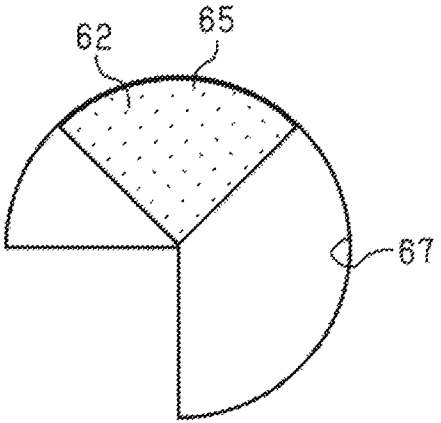
FIG. 14 is a schematic view of a position during a rotation of the rod member according to the second exemplary embodiment.

Upon this, the heating unit 25 is positioned in the second position. Further upon this, the protrusion 65 of the rod member 62 is at a position where gaps are formed between the protrusion 65 and the insertion hole 67 in both clockwise and counterclockwise pivoting directions of the rod member 62, as illustrated in FIG. 14. Thus, the rod member 62 is allowed to pivot in both the clockwise and counterclockwise directions.

When the continuous sheet 12 is jammed between the heating unit 25 and the third support surface 15C during operation of the ink jet-type printer 11, the jammed continuous sheet 12 needs to be removed. To remove the continuous sheet 12 jammed between the heating unit 25 and the third support surface 15C, the heating unit 25 should be caused to pivot from the second position to the first position while the operation of the ink jet-type printer 11 is stopped.

Figure 15:
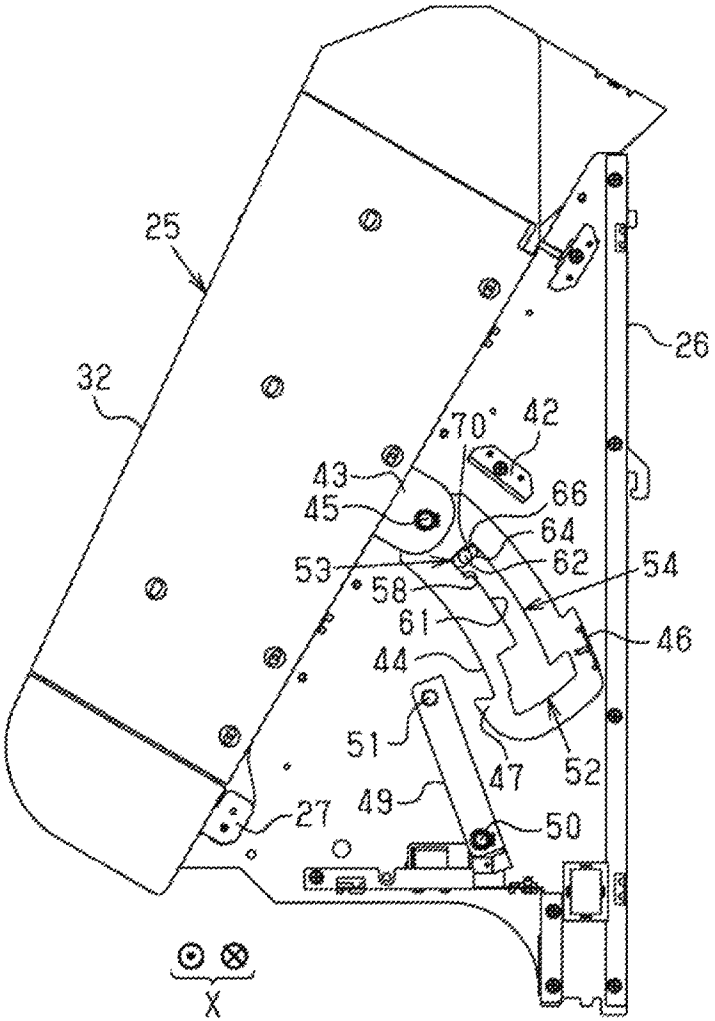
FIG. 15 is a side view illustrating an operation during pivoting of the heating unit according to the second exemplary embodiment.
Figure 16:
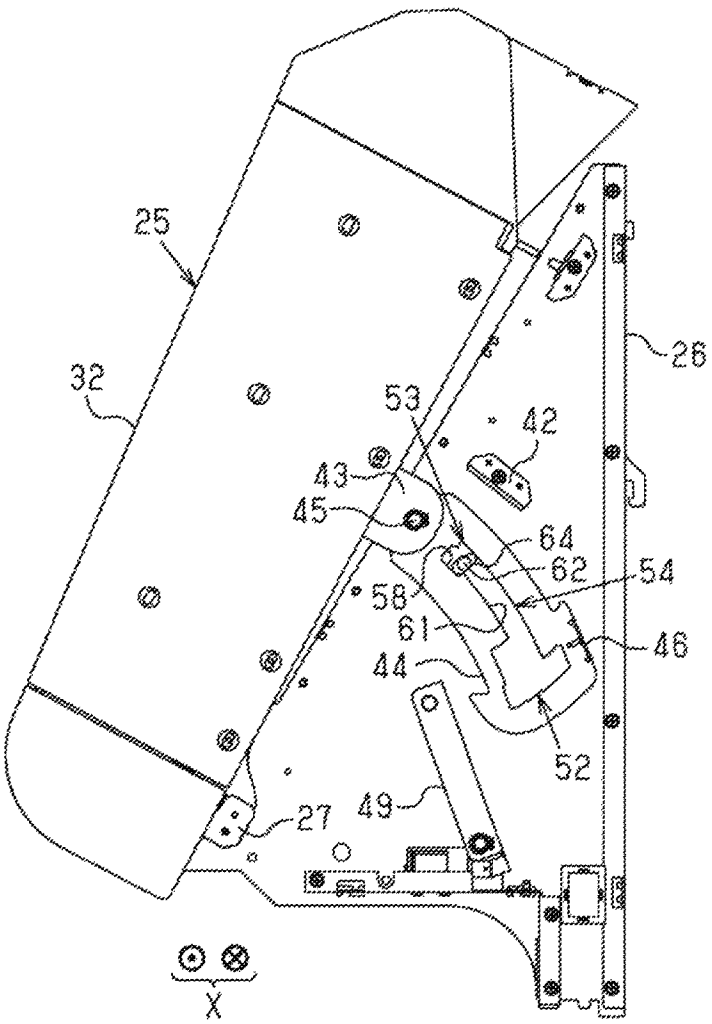
FIG. 16 is a side view illustrating an operation during pivoting of the heating unit according to the second exemplary embodiment.

Then, to pivot the heating unit 25 from the second position to the first position, first the stoppers 49 are caused to pivot from the engaged position to the disengaged position, as illustrated in FIG. 15. This disengages the pins 51 of the stoppers 49 from the hook portions 47 of the guiding parts 44, allowing the heating unit 25 to pivot from the second position to the first position. Subsequently, as the heating unit 25 is caused to pivot toward the first position, the guiding part 44 also moves with the pivoting. As a result, the rod member 62 rotatably supported by the frame 26 slides toward the third area 54 relative to the elongated hole 61, as illustrated in FIG. 16.

Figure 17:
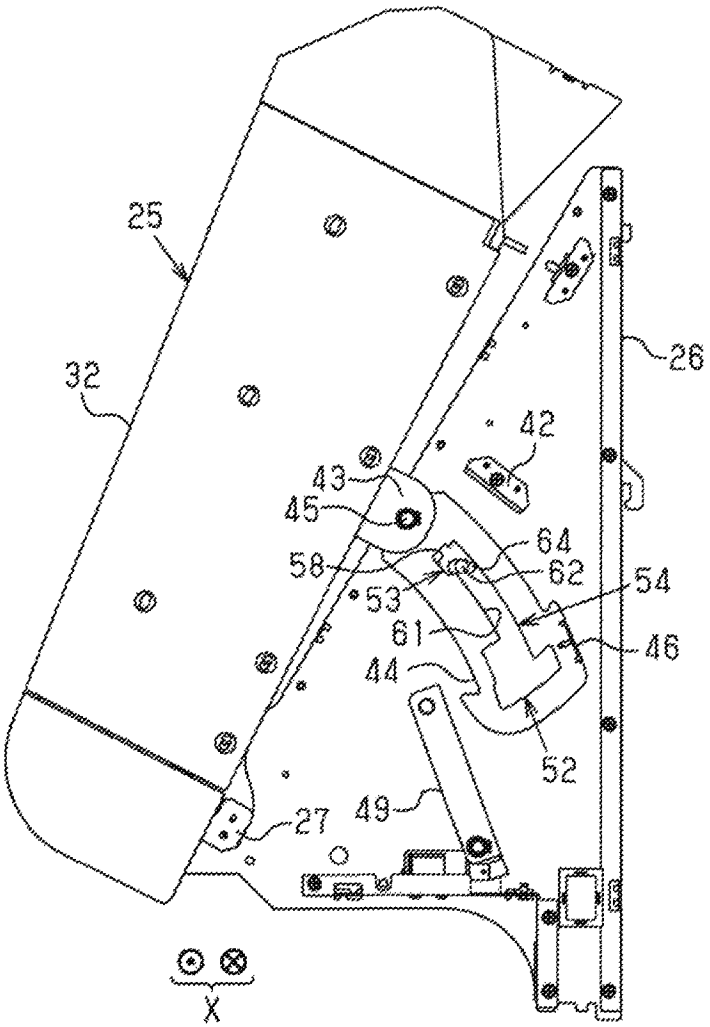
FIG. 17 is a side view illustrating an operation during pivoting of the heating unit according to the second exemplary embodiment.
Figure 18:
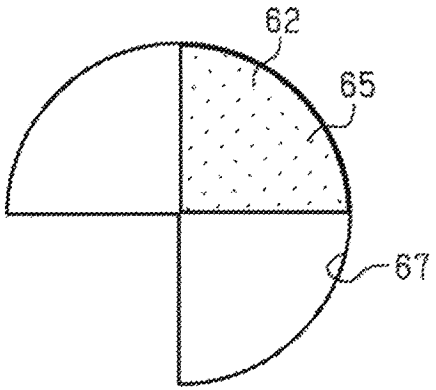
FIG. 18 is a schematic view of a position during a rotation of the rod member according to the second exemplary embodiment.

Upon this, a portion of the sliding portion 64 of the rod member 62 abuts the sidewall of the third recess 58. As the heating unit 25 is continuously caused to pivot toward the first position, a portion of the sliding portion 64 of the rod member 62 is pushed by the sidewall of the third recess 58 to cause the rod member 62 to slightly rotate in the clockwise direction, as illustrated in FIG. 17. That is, the rod member 62 rotates from the position illustrated in FIG. 14 to the position illustrated in FIG. 18.

Figure 19:
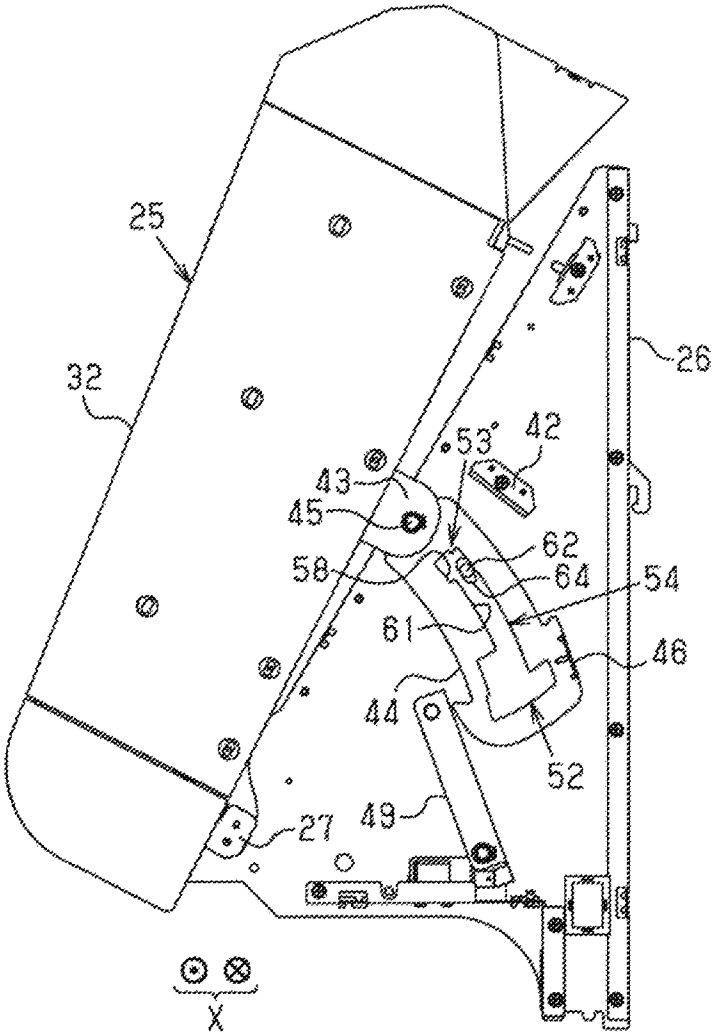
FIG. 19 is a side view illustrating an operation during pivoting of the heating unit according to the second exemplary embodiment.
Figure 20:
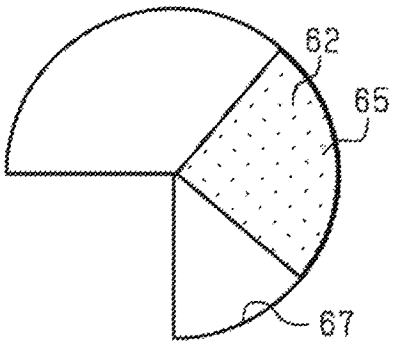
FIG. 20 is a schematic view of a position during a rotation of the rod member according to the second exemplary embodiment.

As the heating unit 25 is continuously caused to pivot toward the first position, a portion of the sliding portion 64 of the rod member 62 is further pushed by the sidewall of the third recess 58 to cause the rod member 62 to slightly rotate in the clockwise direction, as illustrated in FIG. 19. That is, the rod member 62 rotates from the position illustrated in FIG. 18 to the position illustrated in FIG. 20. Upon this, the guiding part 44 slightly pivots about shaft 45 or the pivoting center as the distal end of the guiding part 44 descends by the action of gravity. As a result, the longitudinal direction of the sliding portion 64 of the rod member 62 aligns with the longitudinal direction of the elongated hole 61. This results in the sliding portion 64 of the rod member 62 coming into contact with the upper wall of the elongated hole 61, but not with the lower wall of the elongated hole 61.

Figure 21:
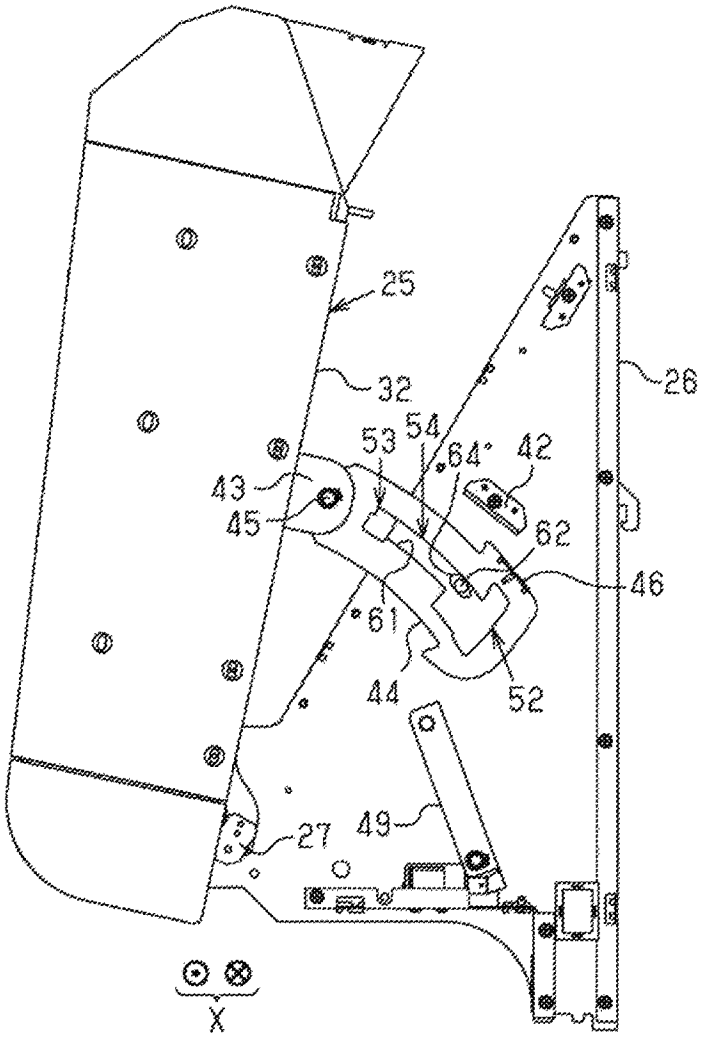
FIG. 21 is a side view illustrating an operation during pivoting of the heating unit according to the second exemplary embodiment.

As the heating unit 25 is continuously caused to pivot to the first position, the rod member 62 slides through the third area 54 toward the first area 52 relative to the elongated hole 61, as illustrated FIG. 21. Upon this, the sliding portion 64 of the rod member 62 is in slidable contact with only the upper wall of the elongated hole 61. In this manner, the sliding resistance between the sliding portion 64 of the rod member 62 and the elongated hole 61 is reduced as compared to when the sliding portion 64 of the rod member 62 is in slidable contact with both the upper and lower walls of the elongated hole 61. That is, as the rod member 62 slides through the third area 54 toward the first area 52 relative to the elongated hole 61, a relatively small braking force is applied as a result of the sliding resistance between the sliding portion 64 of the rod member 62 and the elongated hole 61.

Figure 22:
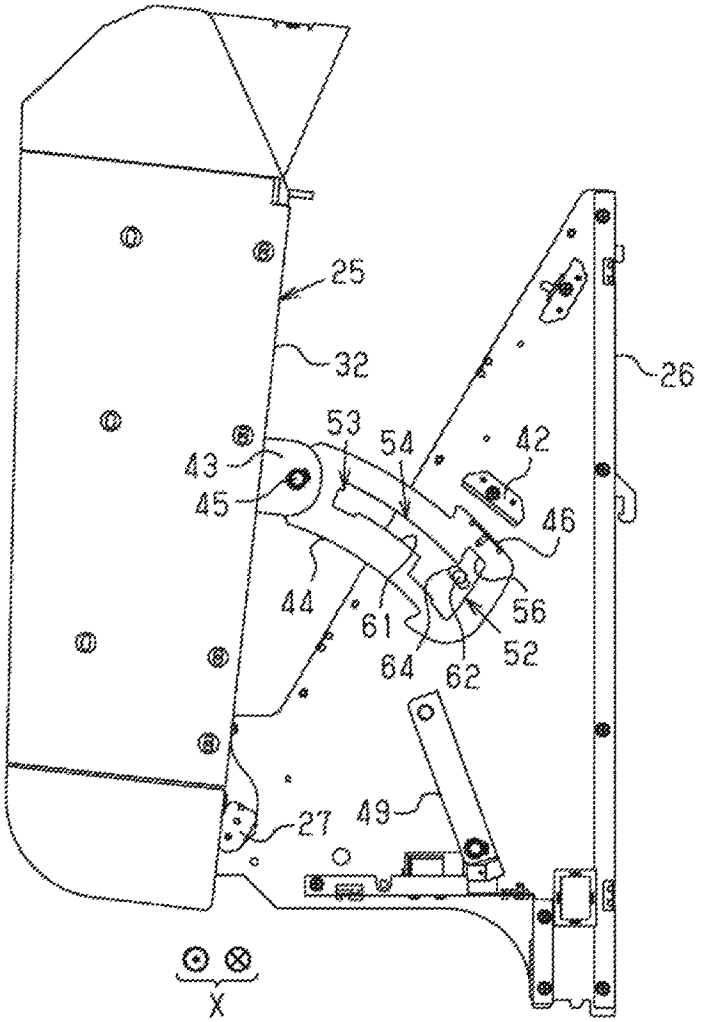
FIG. 22 is a side view illustrating an operation during pivoting of the heating unit according to the second exemplary embodiment.

Subsequently, as the heating unit 25 is caused to pivot to the first position, the rod member 62 rotatably supported by the frame 26 slides from the third area 54 to the first area 52 relative to the elongated hole 48, as illustrated in FIG. 22.

Figure 23:
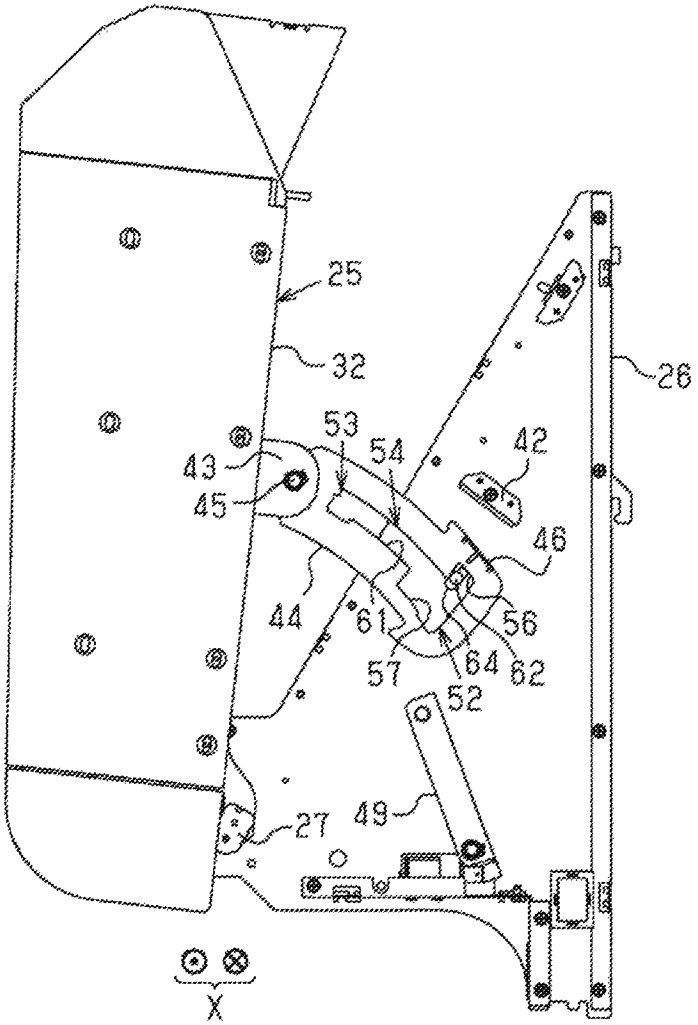
FIG. 23 is a side view illustrating an operation during pivoting of the heating unit according to the second exemplary embodiment.
Figure 24:
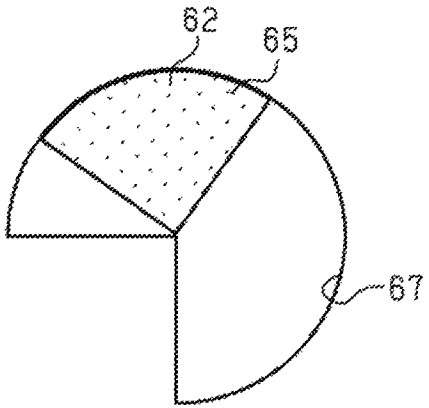
FIG. 24 is a schematic view of a position during a rotation of the rod member according to the second exemplary embodiment.

Consequently, the guiding part 44 pivots about the shaft 45 or the pivoting center as the distal end of the guiding part 44 descends by the action of gravity, thereby causing the rod member 62 to move into the first recess 56, as illustrated in FIG. 23. Upon this, a portion of the sliding portion 64 of the rod member 62 engages with a corner of the first recess 56 near the opening of the first recess 56 to cause the rod member 62 to rotate in the counterclockwise direction. That is, the rod member 62 rotates from the position illustrated in FIG. 20 to the position illustrated in FIG. 24.

In this way, the sliding portion 64 of the rod member 41 and the first recess 56 engage with each other in the pivoting direction of the heating unit 25, restricting the pivoting of the heating unit 25. Thus, the heating unit 25 stably remains still in the first position.

Subsequently, the continuous sheet 12 (see FIG. 1) jammed between the heating unit 25 and the third support surface 15C (see FIG. 1) is removed. Upon this, the distance between the heating unit 25 and the third support surface 15C (see FIG. 1) is largest at the upper edge. Thus, the jammed continuous sheet 12 (see FIG. 1) can be readily accessed from the top and readily removed.

Figure 25:
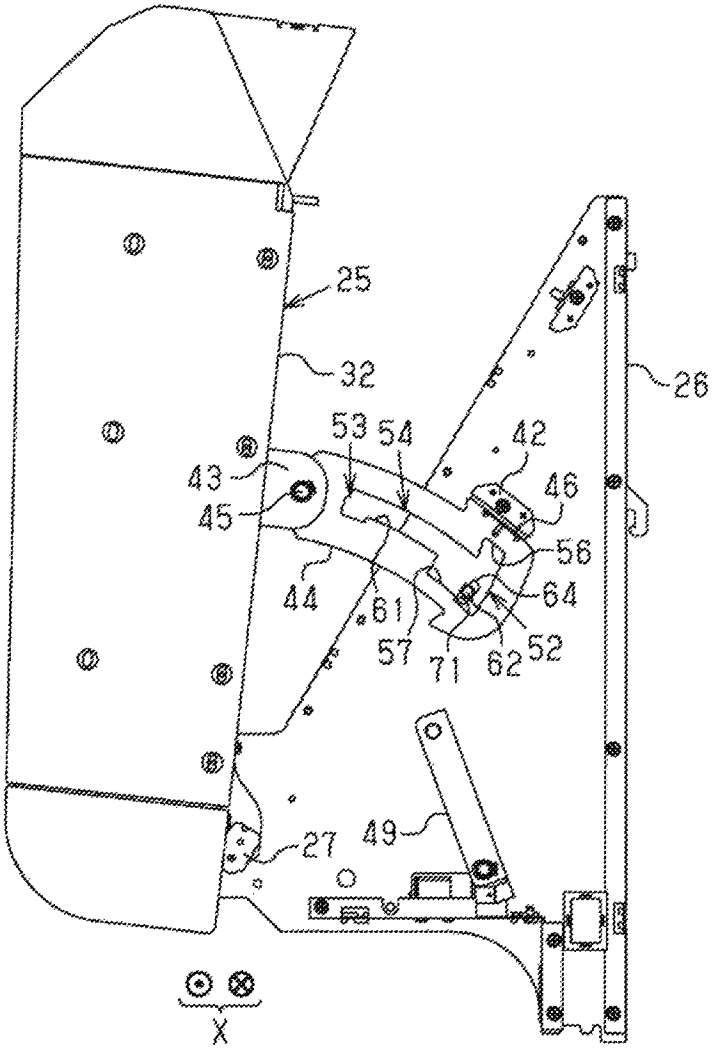
FIG. 25 is a side view illustrating an operation during pivoting of the heating unit according to the second exemplary embodiment.

Once the jammed continuous sheet 12 (see FIG. 1) has been removed, the ink jet-type printer 11 needs to be reactivated, which requires pivoting of the heating unit 25 from the first position to the second position. To pivot the heating unit 25 from the first position to the second position, the guiding part 44 is first caused to pivot about the shaft 45 or the pivoting center to move the distal end of the guiding part 44 upward. This causes the plate 46 to stick to the magnet 42, as illustrated in FIG. 25.

Consequently, the rod member 62 exits the first recess 56 and enters the second recess 57, thus releasing engagement of the sliding portion 64 of the rod member 62 and the first recess 56 in the pivoting direction of the heating unit 25. This allows pivoting of the heating unit 25. Upon this, the sliding portion 64 of the rod member 62 is not in contact with any of the walls of the elongated hole 61.

Figure 26:
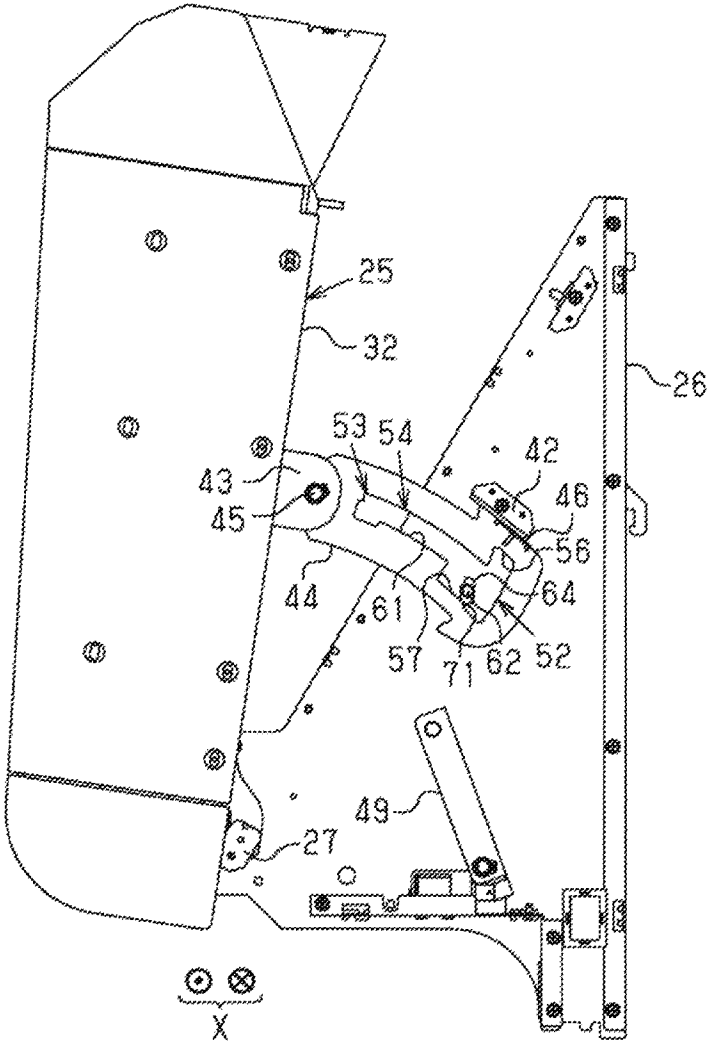
FIG. 26 is a side view illustrating an operation during pivoting of the heating unit according to the second exemplary embodiment.
Figure 27:
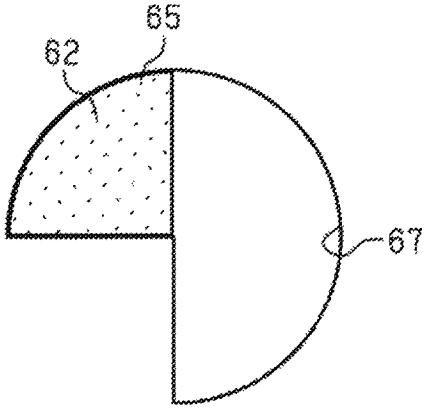
FIG. 27 is a schematic view of a position during a rotation of the rod member according to the second exemplary embodiment.

Subsequently, as the heating unit 25 is caused to pivot toward the second position, a portion of the sliding portion 64 of the rod member 62 engages with the step 71 to cause the rod member 62 to slightly rotate in the counterclockwise direction, as illustrated in FIG. 26. That is, the rod member 62 rotates from the position illustrated in FIG. 24 to the position illustrated in FIG. 27. In other words, the rod member 62 has rotated in the counterclockwise direction to a position where it cannot rotate any farther in the counterclockwise direction.

Figure 28:
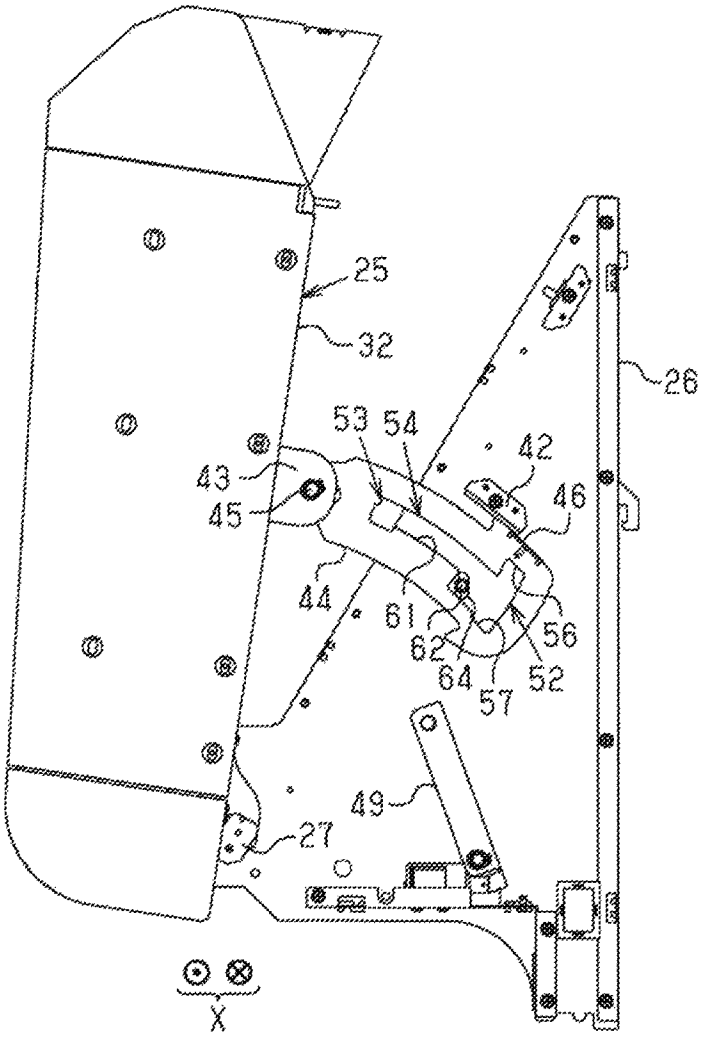
FIG. 28 is a side view illustrating an operation during pivoting of the heating unit according to the second exemplary embodiment.

Subsequently, as the heating unit 25 is caused to pivot toward the second position, the guiding part 44 also moves with the pivoting. As a result, the rod member 62 rotatably supported by the frame 26 moves relative to the second recess 57 to a position at which the rod member 62 does not face the first recess 56 in the short direction of the elongated hole 61, as illustrated in FIG. 28.

Figure 29:
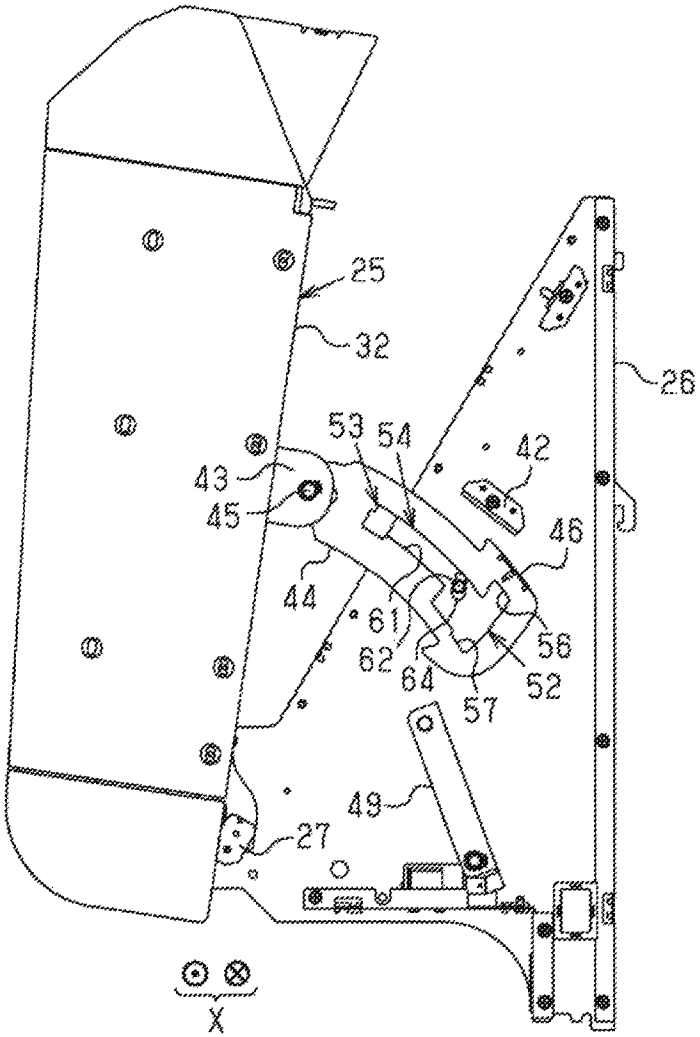
FIG. 29 is a side view illustrating an operation during pivoting of the heating unit according to the second exemplary embodiment.

Upon this, the plate 46 slides over the magnet 42 to a position shifted from where it can stick to the magnet 42. As a result, the plate 46 detaches from the magnet 42, which allows the guiding part 44 to pivot about shaft 45 or the pivoting center as the distal end of the guiding part 44 descends by the action of gravity, as illustrated in FIG. 29. This causes the rod member 62 to exit the second recess 57 and align with the third area 54 in the longitudinal direction of the elongated hole 61.

Figure 30:
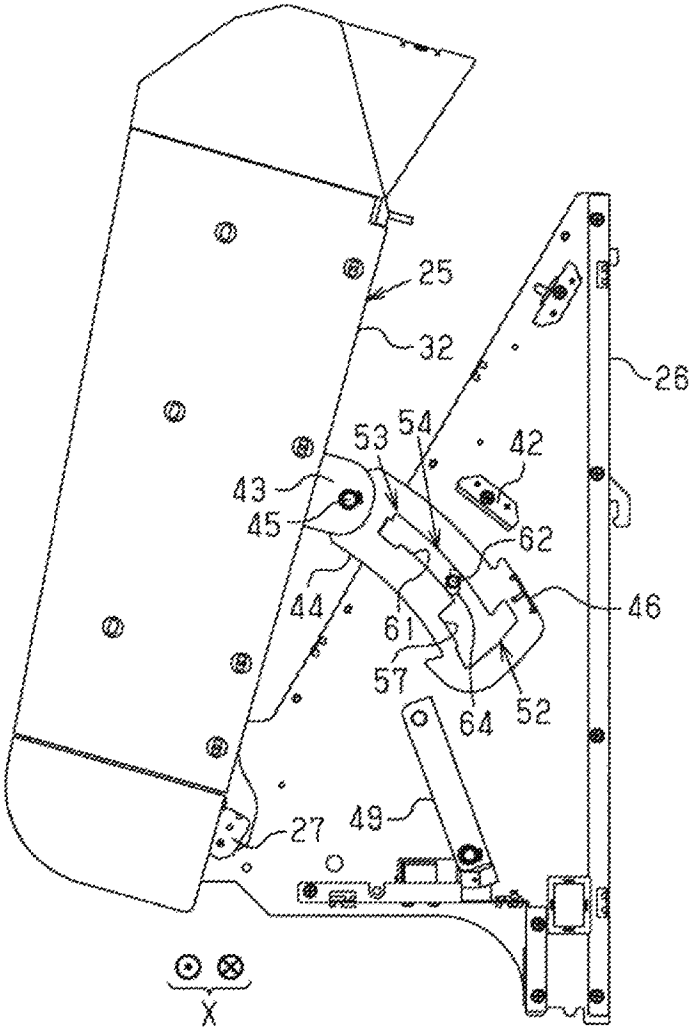
FIG. 30 is a side view illustrating an operation during pivoting of the heating unit according to the second exemplary embodiment.

Upon this, the guiding part 44 applies a load to the sliding portion 64 of the rod member 62 to induce the sliding portion 64 to rotate in the counterclockwise direction. However, the rod member 62 cannot rotate any farther in the counterclockwise direction, as described above. Thus, the rod member 62 does not rotate in the counterclockwise direction. Subsequently, as the heating unit 25 is caused to pivot toward the second position, the guiding part 44 also moves with the pivoting. As a result, the rod member 62 rotatably supported by the frame 26 slides from the first area 52 into the third area 54 relative to the elongated hole 61, as illustrated in FIG. 30.

Upon this, the sliding portion 64 of the rod member 62 while in the third area 54 of the elongated hole 61 is in slidable contact with both the upper and lower walls of the elongated hole 61. As a result, the sliding resistance between the sliding portion 64 of the rod member 62 and the elongated hole 61 is increased as compared to when the sliding portion 64 of the rod member 62 is in slidable contact with only the upper wall of the elongated hole 61.

That is, as the rod member 62 slides through the third area 54 toward the second area 53 relative to the elongated hole 61, a relatively large braking force is applied as a result of the sliding resistance between the sliding portion 64 of the rod member 62 and the elongated hole 61. The braking effect effectively reduces the speed at which the heating unit 25 pivots particularly when the heating unit 25 is heavy and is forcibly caused to pivot by the action of gravity.

Figure 31:
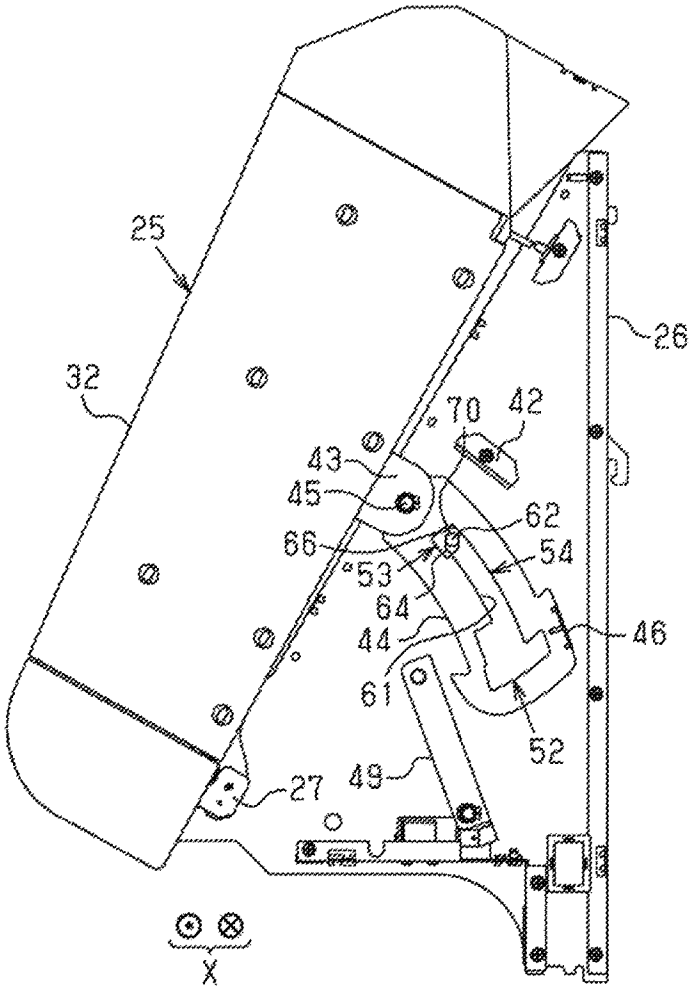
FIG. 31 is a side view illustrating an operation during pivoting of the heating unit according to the second exemplary embodiment.

Subsequently, as the heating unit 25 is caused to pivot toward the second position, the guiding part 44 also moves with the pivoting. As a result, the rod member 62 rotatably supported by the frame 26 slides from the third area 54 into the second area 53 relative to the elongated hole 61, as illustrated in FIG. 31. Upon this, the cutout 66 in the sliding portion 64 of the rod member 62 engages with the protruding portion 70 of the second area 53 in the elongated hole 61.

Subsequently, as the heating unit 25 is caused to pivot to the second position, the cutout 66 in the sliding portion 64 of the rod member 62 is pushed by the protruding portion 70 to cause the rod member 62 to slightly rotate in the clockwise direction, as illustrated in FIG. 15. That is, the rod member 62 rotates from the position illustrated in FIG. 27 to the position illustrated in FIG. 14.

Subsequently, the stoppers 49 are caused to pivot from the disengaged position to the engaged position. As illustrated in FIG. 13, this engages the pins 51 of the stoppers 49 with the hook portions 47 of the guiding parts 44, thus restricting the heating unit 25 from pivoting from the second position toward the first position. Then, the ink jet-type printer 11 is activated.

According to the second exemplary embodiment described above, the following advantages can be achieved in addition to the advantages described above in (1-1) to (1-6).

(2-1) In the ink jet-type printer 11, the sliding resistance between the third area 54 of the elongated hole 61 and the sliding portion 64 of the rod member 62 during pivoting of the heating unit 25 from the second position to the first position can be made smaller than the sliding resistance between the third area 54 of the elongated hole 61 and the sliding portion 64 of the rod member 62 during pivoting of the heating unit 25 from the first position to the second position. Thus, the braking effect in the third area 54 of the elongated hole 61 can be reduced during pivoting of the heating unit 25 from the second position to the first position against gravity, and the braking effect in the third area 54 of the elongated hole 61 can be increased during pivoting of the heating unit 25 from the first position to the second position by making use of gravity. Thus, even when the heating unit 25 is heavy, the heating unit 25 can be readily caused to pivot from the second position to the first position, and the heating unit 25 can be slowly and readily caused to pivot from the first position to the second position.

MODIFICATION EXAMPLES

Note that, the exemplary embodiments described above may be modified as follows.

- The width of the first area 52 in the short direction of the elongated hole 48 in the guiding part 44 and the width in the second area 53 in the short direction of the elongated hole 48 do not necessarily have to be larger than the width of the third area 54 in the short direction of the elongated hole 48.
- The rod members 41 do not necessarily have to be formed of a material harder than that of the guiding parts 44. For example, the rod members 41 and the guiding parts 44 may be formed of the same material or the rod members 41 may be formed of a material softer than that of the guiding parts 44.
- The sliding-resistance increasing portions 55 of the elongated holes 48 in the guiding parts 44 may be omitted.
- The sliding-resistance increasing portions 55 of the elongated holes 48 may be provided by forming curved portions in the elongated holes 48.
- The elongated holes 48 in the guiding parts 44 may be cutout grooves.
- The elongated holes 48 in the guiding parts 44 may be tapered such that the width gradually decreases along the longitudinal direction.
- The step between the second recess 57 and the third area 54 of the elongated hole 48 in each guiding unit 44 may be replaced with a smooth slope.
- The braking mechanism may be omitted.
- The guiding unit 44 may be provided on the frame 26, and the rod member 41 may be provided on the heating unit 25.
- The recording apparatus may also be an industrial device for manufacturing a part of an electronic component using printing technology (ink jet technology). For example, the recording apparatus is used in the manufacture of liquid crystal displays, electroluminescent (EL) displays, surface emitting displays, or the like, where an electrode material or a color material (pixel material) or the like may be formed by discharging a liquid.

This application claims priority under 35 U.S.C. § 119 to Japanese Patent Application No. 2018-060398, filed Mar. 27, 2018. The entire disclosure of Japanese Patent Application No. 2018-060398 is hereby incorporated herein by reference.

What is claimed is:

1. A recording apparatus comprising:

a recording unit configured to perform recording on a medium transported along a transport path;

a medium support unit disposed downstream of the recording unit in the transport path and configured to support the medium, on which the recording has been performed by the recording unit;

a heater disposed to face the medium support unit and configured to heat the medium supported by the medium support unit, wherein the heater is pivotable away from the medium support unit about a hinge portion serving as a pivoting center disposed on the heater at an end portion downstream in the transport direction of the medium; and a braking mechanism configured to reduce a pivoting speed of the heater, wherein the braking mechanism includes an engaging portion disposed on one of the medium support unit and the heater, and a guiding part disposed on the other of the medium support unit and the heater and configured to slidably guide the engaging portion, and wherein when the heater is caused to pivot, the pivoting speed of the heater is reduced by a sliding resistance between the engaging portion and the guiding part.

2. The recording apparatus according to claim 1, wherein, the engaging portion includes a rod member, and the guiding part has an elongated hole into which the rod member is slidably inserted.

3. The recording apparatus according to claim 2, wherein the elongated hole is partially provided with a sliding-resistance increasing portion in which sliding resistance between the rod member and the sliding-resistance increasing portion increases.

4. The recording apparatus according to claim 2, wherein the rod member is formed of a material harder than a material of the guiding part.

5. The recording apparatus according to claim 2, wherein, in a short direction, a width of a first area of the elongated hole where the rod member is positioned when the heater is pivoted to a first position farthest from the medium support unit and a width of a second area of the elongated hole where the rod member is positioned when the heater is pivoted to a second position closest to the medium support unit are larger than a width of a third area of the elongated hole where the rod member is positioned when the heater is pivoted between the first position and the short direction.

* * * * *